US007734227B2

(12) United States Patent
Uetake et al.

(10) Patent No.: US 7,734,227 B2
(45) **Date of Patent: *Jun. 8, 2010**

(54) DEVELOPING DEVICE AND IMAGE-FORMING APPARATUS USING MULTIPLE-COMPONENT DEVELOPER

(75) Inventors: Shigeo Uetake, Takatsuki (JP); Yuji Nagatomo, Osaka (JP); Junya Hirayama, Takarazuka (JP); Takeshi Maeyama, Kawanishi (JP); Masahiko Matsuura, Suita (JP); Toshiya Natsuhara, Takarazuka (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 577 days.

This patent is subject to a terminal disclaimer.

(21) Appl. No.: 11/519,597

(22) Filed: Sep. 12, 2006

(65) Prior Publication Data

US 2007/0071506 A1 Mar. 29, 2007

(30) Foreign Application Priority Data

Sep. 16, 2005 (JP) ..... 2005-269676
Nov. 4, 2005 (JP) ..... 2005-320807
Jul. 4, 2006 (JP) ..... 2006-184714

(51) Int. Cl.
*G03G 15/09* (2006.01)

(52) U.S. Cl. ..... 399/253; 399/270; 399/272

(58) Field of Classification Search ..... 399/253, 399/267, 272, 274, 270
See application file for complete search history.

(56) References Cited

U.S. PATENT DOCUMENTS 4,639,115 A * 1/1987 Lin ..... 399/253
5,231,458 A 7/1993 Nishimura et al.
5,391,455 A * 2/1995 Bigelow ..... 399/254
5,506,372 A * 4/1996 Guth et al. ..... 399/254
5,802,430 A 9/1998 Wada
5,991,587 A 11/1999 Kikuchi (Continued)

FOREIGN PATENT DOCUMENTS

EP 654 714 A 1/1994

(Continued)

OTHER PUBLICATIONS

Partial European Search Report, Application No. EP 06019262 dated Dec. 8, 2006.

(Continued)

*Primary Examiner*—William J Royer
(74) *Attorney, Agent, or Firm*—Brinks Hofer Gilson & Lione

(57) ABSTRACT

A developing device 2*a*, which is provided with: a developer tank 16 that houses a developer 24 containing a toner, a carrier for charging the toner and reverse polarity particles that are charged with a polarity reversed to the electrostatic charge polarity of the toner by the carrier; a developer-supporting member 11 that supports the developer supplied from the developer tank on the surface thereof, and transports the developer; and a separating mechanism 22 that separates the toner or the reverse polarity particles from the developer supported on the developer-supporting member, and the reverse polarity particles are collected into the developer tank, is provided, and an image-forming apparatus having such a developing device and an image-forming method applied thereto are also provided.

32 Claims, 8 Drawing Sheets

U.S. PATENT DOCUMENTS

| | | | | |
|---|---|---|---|---|
| 6,463,245 | B1 | 10/2002 | Suwa et al. | |
| 6,512,909 | B2 | 1/2003 | Ozawa et al. | |
| 6,721,516 | B2 | 4/2004 | Aoki et al. | |
| 2004/0228661 | A1 | 11/2004 | Fujishima et al. | |
| 2007/0092306 | A1 * | 4/2007 | Matsuura et al. | 399/267 |

FOREIGN PATENT DOCUMENTS

| | | | |
|---|---|---|---|
| EP | 0 772 097 | A2 | 5/1997 |
| EP | 1 324 149 | A2 | 7/2003 |
| JP | 59-100471 | | 6/1984 |
| JP | 06 295123 | A | 10/1994 |
| JP | 09-185247 | | 7/1997 |
| JP | 2000-298396 | | 10/2000 |
| JP | 2002-108104 | | 4/2002 |
| JP | 2003-057882 | | 2/2003 |
| JP | 2003-215855 | | 7/2003 |
| JP | 2005-189708 | | 4/2005 |

OTHER PUBLICATIONS

Partial European Search Report, Application No. EP 06019262.2 dated May 9, 2007, 2 pages.

First Office Action dated Apr. 14, 2009 issued in U.S. Appl. No. 11/584,891.

Final Office Action dated Nov. 10, 2009 issued in related U.S. Appl. No. 11/584,891.

Non-final Office Action dated Aug. 7, 2009 issued in related U.S. Appl. No. 11/805,815.

* cited by examiner

DEVELOPING DEVICE AND IMAGE-FORMING APPARATUS USING MULTIPLE-COMPONENT DEVELOPER

This application is based on application(s) No. 2005-269676, 2005-320807 and 2006-184714 filed in Japan, the contents of which are hereby incorporated by reference.

BACKGROUND OF THE INVENTION

1. Field of the Invention

This invention relates to an image-forming apparatus such as a copying machine and a printer in which an electrophotographic system is used and a developing device for developing an electrostatic latent image formed on an image supporting member, and more particularly, concerns a developing device in which a developer composed of two components of a toner and a carrier and an image-forming apparatus using such a device.

2. Description of the Related Art

Conventionally, with respect to a developing system for an electrostatic latent image formed on an image supporting member in the image-forming apparatus using the electrophotographic system, a one-component developing system that uses only the toner as a developer and a two-component developing system that uses a toner and a carrier have been known. In the one-component developing system, in general, the toner is allowed to pass through a regulating section that is constituted by a toner-supporting member and a regulating plate pressed onto the toner-supporting member so that the toner is charged and a desired thin toner layer is obtained; therefore, this system is advantageous from the viewpoints of simplifying and miniaturizing the device and of achieving low costs. In contrast, due to a strong stress in the regulating section, the toner is easily deteriorated to cause degradation in the toner charge-receiving property. Moreover, the toner regulating member and the surface of the toner-supporting member are contaminated by the toner and externally additive agents, with the result that the charge-applying property to the toner is lowered to cause problems such as fogging and the subsequent short service life of the developing device.

In comparison with the one-component developing system, the two-component developing system, which charges the toner through a friction-charging process upon mixing with the carrier, can reduce the stress, and is advantageous in preventing toner deterioration. Moreover, the carrier serving as a charge-applying material to the toner has a greater surface area so that it is relatively resistant to contamination due to the toner and externally additive agents, and is advantageous in prolonging the device service life.

However, even in the case of the two-component developer, the contamination on the carrier surface due to the toner and externally additive agents also occurs to cause reduction in the quantity of charge in toner after a long-term use, resulting in problems such as fogging and toner scattering; therefore, the device service life is not sufficient, and there is a strong demand for a longer service life.

With respect to a method for prolonging the life of the two component developer, Patent Document 1 has disclosed a developing device in which the carrier, alone or together with the toner, is supplied little by little, while a deteriorated developer having a reduced electrostatic charge property (simply referred to as "charge property") is discharged in response to the supply so that the carrier is exchanged to prevent increase in the ratio of the deteriorated carrier. In this device, since the carrier is exchanged, the reduction in the quantity of charge in toner due to the deteriorated carrier can be suppressed in a certain level, making it possible to provide a long service life. However, since a mechanism for collecting the discharged carrier is required, and since the carrier is used as a consumable supply, problems arise in costs, environmental preservation, and the like. Moreover, since a predetermined number of printing processes need to be repeated until the ratio of the new and old carriers has been stabilized, there is a failure to maintain and effectively use the initial properties.

Patent Document 2 has disclosed a two component developer composed of a carrier and a toner to which particles that exert a charge property with a reverse polarity to the toner charge polarity are externally added, and a developing method using such a developer. In the developing method of Patent Document 2, the reverse polarity-chargeable particles are added in an attempt to add functions as a polishing agent and spacer particles, and it describes that by the effect of removing spent matters on the carrier surface, the degradation preventive effect is obtained. Moreover, it also describes that in the cleaning unit in the image supporting member, the cleaning property is improved, and that the polishing effect of the image supporting member is obtained. However, in the disclosed developing method, the amounts of consumption in the toner and the reverse polarity-chargeable particles are different depending on the image area rate, and in particular, in the case of a small image area rate, the consumption of the reverse polarity-chargeable particles becomes excessive, causing degradation in the carrier deterioration preventive effect in the developing device.

[Patent Document 1] Japanese Patent Application Laid-Open No. 59-100471

[Patent Document 2] Japanese Patent Application Laid-Open No. 2003-215855

BRIEF SUMMARY OF THE INVENTION

A main objective of the present invention is to provide a developing device and an image-forming apparatus, which can prevent the carrier from deteriorating for a long time even in the case when an image having a comparatively small image area is continuously formed.

The present invention also relates to a developing device, particularly a compact developing device which prevents the carrier from deteriorating and properly maintains a cleaning performance of the image supporting member so that a superior image-forming process is carried out for a long time.

A developing device, which is provided with: a developer tank that houses a developer containing a toner, a carrier for charging the toner and reverse polarity particles that are charged with a polarity reversed to the electrostatic charge polarity of the toner by the carrier; a developer-supporting member that supports the developer supplied from the developer tank on the surface thereof, and transports the developer; and a separating mechanism that separates the toner or the reverse polarity particles from the developer supported on the developer-supporting member, and the reverse polarity particles are collected into the developer tank, is provided, and an image-forming apparatus having such a developing device, and an image-forming method applied thereto are also provided.

DETAILED DESCRIPTION OF THE INVENTION

The present invention relates to a developing device, comprising:

a developer tank that houses a developer containing a toner, a carrier for charging the toner and reverse polarity particles that are charged with polarity reversed to the charge polarity of the toner;

a developer-supporting member that supports the developer supplied from the developer tank to transport the developer toward a developing area; and a separating mechanism that separates the reverse polarity particles or the toner from the developer supported on the developer-supporting member on the upstream side of the developer-moving direction, and the present invention also relates to an image-forming apparatus having such a developing device, and an image-forming method applied thereto

EFFECTS OF THE INVENTION

In the present invention, since the consumption of reverse polarity particles can be suppressed, it becomes possible to reduce influences caused by variations in the amount of consumption of reverse polarity particles depending on the image area rate, and consequently to prevent the reverse polarity particles from being excessively consumed, in particular when the image area rate is low (in which the toner consumption is small). Moreover, the reverse polarity particles can effectively compensate the carrier for its charging property, thereby making it possible to prevent degradation in the carrier for a long time as a result. For this reason, even in the case when an image having a comparatively small image area is continuously formed, the quantity of charge in toner can be maintained effectively for a long time.

BEST MODE FOR CARRYING OUT THE INVENTION

Referring to Figures, the following description will discuss embodiments of the present invention.

Figure 1:
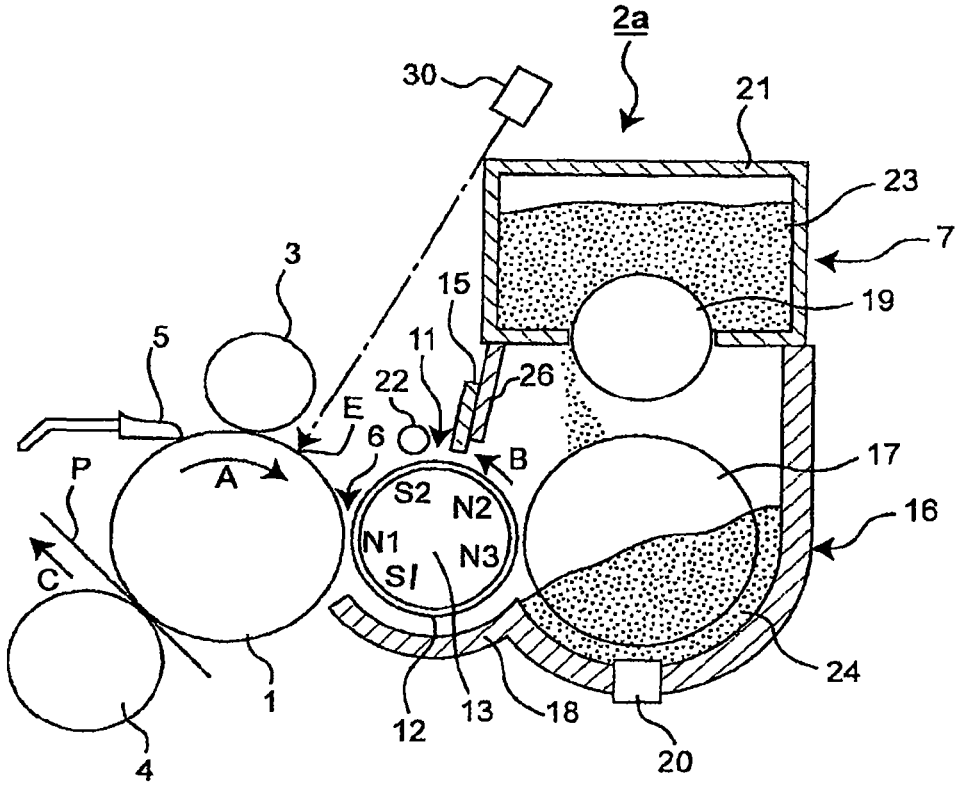
FIG. 1 is a schematic diagram that shows a main portion of an image-forming apparatus in accordance with one embodiment of the present invention.

FIG. 1 shows a main portion of an image-forming apparatus in accordance with one embodiment of the present invention. This image-forming apparatus is a printer which carries out an image-forming process by transferring a toner image formed on an image supporting member (photoconductive member) 1 onto a copying medium P such as paper through an electrophotographic system. This image-forming apparatus has the image supporting member 1 on which an image is supported, and on the periphery of the image supporting member 1, a charging member 3 serving as charging means for charging the image supporting member 1, a developing device 2*a* for developing an electrostatic latent image on the image supporting member 1, a transferring roller 4 for transferring a toner image on the image supporting member 1 and a cleaning blade 5 for removing residual toner from the image supporting member 1 are placed in succession along the rotation direction A of the image supporting member 1.

After having been charged by the charging member 3, the image supporting member 1 is exposed by an exposing device 30 provided with a laser light emitter or the like at a position indicated by point E in the Figure so that an electrostatic latent image is formed on the surface thereof. The developing device 2*a* develops this electrostatic latent image to make a toner image. After transferring the toner image on the image supporting member 1 onto the copying medium P, the transferring roller 4 discharges the medium in the direction of arrow C in the Figure. The cleaning blade 5 removes residual toner on the image supporting member 1 after the transferring process by using its mechanical force. With respect to the image supporting member 1, the charging member 3, the exposing device 30, the transferring roller 4, the cleaning blade 5 and the like, those devices in the conventionally-known electrophotographc system may be optionally used. For example, the charging roller is shown in the Figure as the charging means; however, a charging device used in a non-contact state to the image supporting member 1 may be used. Moreover, for example, the cleaning blade may be omitted.

In the present embodiment, the developing device 2*a* is characterized by including a developer tank 16 housing a developer 24, a developer-supporting member 11 that supports the developer 24 supplied from the developer tank 16 on the surface, and transports the developer 24, and a separating mechanism that separates toner or reverse polarity particles from the developer supported on the developer-supporting member 11, and the reverse polarity particles are collected in the developer tank 16. With this arrangement, the consumption of the reverse polarity particles can be suppressed, and the reverse polarity particles are allowed to effectively compensate the carrier for its charge property, thereby making it possible to prevent degradation in the carrier for a long time as a result. For this reason, even in the case when an image having a comparatively small image area is continuously formed, the quantity of charge in toner can be maintained effectively for a long time.

In the case when the developing device does not have the above-mentioned separating mechanism, the carrier degradation suppressing effect in the developing device is lowered, in particular when the image area rate is small. The occurrence of this phenomenon is explained as follows: In the two-component developing device, by forming a strong electric field by applying, for example, a vibration electric field in its developing area, the toner separating property from the carrier in the developer is improved so that the developing effect is improved; thus, when a developer including reverse polarity particles is used, the three components, that is, the carrier, toner and reverse polarity particles are separated from one another, and although the carrier remains on the developer-supporting member by a magnetic attracting force, the toner is consumed by the image portion of an electrostatic latent image, and the reverse polarity particles are consumed by the non-image portion thereof, respectively. Therefore, depending on the image area rate, the consumption balance between the toner and the reverse polarity particles becomes unstable, and in particular, when a large number of images, each having a large background area, are printed, the reverse polarity particles in the developer are preferentially consumed, failing to compensate for the charge property of the carrier to cause a reduction in the carrier degradation preventive effect.

In the present embodiment, the developer 24 contains a toner, a carrier for charging the toner and reverse polarity particles. The reverse polarity particles can be charged with a reverse polarity to the toner charge polarity by the carrier to be used. For example, when the toner is negatively charged by the carrier, the reverse polarity particles are positively chargeable particles that are positively charged in the developer. When the toner is positively charged by the carrier, the reverse polarity particles are negatively chargeable particles that are negatively charged in the developer. By allowing the two-component developer to contain the reverse polarity particles, and by also allowing the separating mechanism to accumulate the reverse polarity particles in the developer during endurance use, the reverse polarity particles can also charge the toner to have a regular polarity, even in the case when the charge property of the carrier is lowered due to spent matters onto the carrier caused by the toner and post-treatment agent; therefore, it becomes possible to effectively compensate the charge property of the carrier, and consequently to prevent degradation in the carrier.

Reverse polarity particles to be desirably used are appropriately selected depending on the electrostatic charge polarity of the toner. In the case when a negatively chargeable toner is used as the toner, fine particles having a positively chargeable property are used as the reverse polarity particles, and examples thereof include: inorganic fine particles, such as strontium titanate, barium titanate and alumina, and fine particles composed of a thermoplastic resin or a thermosetting resin, such as acrylic resin, benzoguanamine resin, nylon resin, polyimide resin and polyamide resin, and a positive charge controlling agent for providing a positive charge property to the resin may be added to the resin, or a copolymer of a nitrogen-containing monomer may be formed. With respect to the positive charge controlling agent, examples thereof include: nigrosine dyes and quaternary ammonium salts, and with respect to the nitrogen-containing monomers, examples thereof include: 2-dimethylaminoethyl acrylate, 2-diethylaminoethyl acrylate, 2-dimethylaminoethyl methacrylate, 2-diethylaminoethyl methacrylate, vinyl pyridine, N-vinyl carbazole and vinyl imidazole.

In contrast, in the case when a positive chargeable toner is used, fine particles having a positive charge property are used as the reverse polarity particles, and in addition to inorganic fine particles such as silica and titanium oxide, examples thereof include: fine particles composed of a thermoplastic resin or a thermosetting resin such as fluororesin, polyolefin resin, silicone resin and polyester resin, and a negative charge controlling agent for providing a negative charge property may be added to the resin, or a copolymer of a fluorine-containing acrylic monomer or a fluorine-containing methacrylic monomer may be formed. With respect to the negative charge controlling agent, examples thereof include: salicylic acid-based or naphthol-based chromium complexes, aluminum complexes, iron complexes and zinc complexes.

In order to control the charge property and hydrophobic property of the reverse polarity particles, the surface of the inorganic fine particles may be surface-treated with a silane coupling agent, a titanium coupling agent, silicone oil or the like, and in particular, in the case when a positive charge property is applied to the inorganic fine particles, the particles are preferably surface-treated with an amino-group-containing coupling agent, and in the case when a negative charge property is applied, the particles are preferably surface-treated with a fluorine-group-containing coupling agent.

The number average primary particle size of the reverse polarity particles is preferably set in the range from 100 to 1000 nm. Thereby, the deterioration of carrier can be restrained effectively.

As another embodiment, such reverse polarity particles as have particle size distribution with a peak particle diameter in the range from 0.8 μm to 1.5 μm may be used. In this case, the second large particles having a particle size distribution with a peak particle size of 0.2 to 0.6 μm is contained. Thereby, the carrier deterioration can be prevented, the cleaning performance of the photoconductive member is properly maintained and it becomes possible to form superior images for a long time.

The second large particles may be the same kinds of particles as those exemplified as the reverse polarity particles. In addition, metal oxide particles, such as zinc oxide, may be used. The polarity relative to the toner of the second large particles may be set to either of the polarities; however, from the viewpoint of prevention of reduction in quantity of charge during the endurance operation, the reverse polarity to the toner polarity is preferable. Presumably, the reduction in quantity of charge is caused by the fact that when the particles are spent on the carrier surface, the charging capability of the carrier is slightly lowered.

With respect to the toner, not particularly limited, conventionally-known toners generally used may be adopted, and a toner, formed by adding a colorant, or, if necessary, a charge controlling agent, a releasing agent or the like, to a binder resin, with an externally-added agent being applied thereto, may be used. With respect to the toner particle size, although not particularly limited, it is preferably set in the range from 3 to 15 μm.

Upon manufacturing such a toner, a conventionally-known method, generally used, may be used, and for example, a grinding method, an emulsion polymerization method, a suspension polymerization method and the like may be used.

With respect to the binder resin used for the toner, although not particularly limited to these, examples thereof include: styrene-based resin (homopolymer or copolymer containing styrene or a styrene-substituent), polyester resin, epoxy resin, vinyl chloride resin, phenol resin, polyethylene resin, polypropylene resin, polyurethane resin and silicone resin. A resin simple substance or a composite resin of these may be used, and those having a softening temperature in the range from 80 to 160° C. or those having a glass transition point in the range from 50 to 75° C. are preferably used.

With respect to the colorant, conventionally-known colorants, generally used, can be used, and examples thereof include: carbon black, aniline black, activated carbon, magnetite, benzene yellow, Permanent Yellow, Naphthol Yellow, Phthalocyanine Blue, Fast Sky Blue, Ultramarine Blue, Rose Bengale and Lake Red. In general, the colorant is preferably used at a rate of 2 to 20 parts by weight with respect to 100 parts by weight of the above-mentioned binder resin.

With respect to the charge controlling agent, any of conventionally-known agents may be used, and with respect to the charge controlling agent for positive chargeable toners, examples thereof include: nigrosine based dyes, quaternary ammonium salt compounds, triphenyl methane compounds, imidazole compounds and polyamine resin.

With respect to the charge controlling agent for negative chargeable toners, examples thereof include: azo-based dyes containing metal, such as Cr, Co, Al and Fe, salicylic acid metal compounds, alkyl salicylic acid metal compounds and calix arene compounds. In general, the charge controlling agent is preferably used at a rate of 0.1 to 10 parts by weight with respect to 100 parts by weight of the above-mentioned binder resin.

With respect to the releasing agent, any of generally-used conventionally-known agents may be used, and examples thereof include: polyethylene, polypropylene, carnauba wax and sazol wax, and each of these may be used alone, or two or more kinds of these may be used in combination. In general, the releasing agent is preferably used at a rate of 0.1 to 10 parts by weight with respect to 100 parts by weight of the above-mentioned binder resin.

With respect to the externally additive agent, any of generally-used conventionally-known agents may be used, and fluidity-improving agents, for example, inorganic fine particles such as silica, titanium oxide and aluminum oxide and resin fine particles, such as acrylic resin, styrene resin, silicone resin and fluororesin, may be used, and in particular, those agents subjected to a hydrophobicizing treatment with a silane coupling agent, a titan coupling agent or silicone oil may be preferably used. The fluidity-improving agent is added at a rate of 0.1 to 5 parts by weight with respect to 100 parts by weight of the above-mentioned toner. The number average primary particle size of the externally additive agent is set in the range between 9 and 100 nm. Preferably, at least one kind of externally additive agents (inorganic fine particles) having a number average primary particle size in the range from 20 to 40 nm are contained. More preferably, an externally additive agent (inorganic fine particles) having a number average primary particle size in the range from 9 to 16 nm are further contained.

With respect to the carrier, not particularly limited, generally-used conventionally-known carriers may be used, and binder-type carriers, coat-type carriers and the like may be used. With respect to the carrier particle size, although not particularly limited, it is preferably set in the range from 15 to 100 μm.

The binder-type carrier has a structure in which magnetic material fine particles are dispersed in a binder resin, and positive or negative chargeable fine particles may be affixed onto the carrier surface or a surface coating layer may be formed. The charging properties such as a polarity of the binder-type carrier can be controlled by adjusting the material for the binder resin, the chargeable fine particles and the kind of the surface coating layer.

With respect to the binder resin used for the binder-type carrier, examples thereof include: thermoplastic resins, such as vinyl-based resins typically represented by polystyrene-based resins, polyester-based resins, nylon-based resins and polyolefin-based resins, and thermosetting resins such as phenol resins.

With respect to the magnetic material fine particles used for the binder-type carrier, magnetite, spinel ferrite such as gamma iron oxide, spinel ferrite containing one kind or two or more kinds of metals (Mn, Ni, Mg, Cu and the like) other than iron, magneto planbite-type ferrite, such as barium ferrite, and particles of iron or its alloy with an oxide layer formed on the surface may be used. The shape thereof may be any of a particle shape, a spherical shape and a needle shape. In particular, in the case when high magnetization is required, iron-based ferromagnetic fine particles are preferably used. From the viewpoint of chemical stability, ferromagnetic fine particles of magnetite, spinel ferrite, such as gamma iron oxide and of magneto planbite-type ferrite, such as barium ferrite, are preferably used. By appropriately selecting the kind and content of the ferromagnetic fine particles, it is possible to obtain a magnetic resin carrier having desired magnetization. The magnetic fine particles are preferably added to the magnetic resin carrier at an amount of 50 to 90% by weight.

With respect to the surface coat material of the binder-type carrier, silicone resin, acrylic resin, epoxy resin, fluororesin and the like may be used, and the surface is coated with any of these resins to be cured thereon to form a coat layer so that the charge-applying property can be improved.

The anchoring process of the chargeable fine particles or conductive fine particles onto the surface of the binder-type carrier is carried out, for example, through steps in which the magnetic resin carrier and the fine particles are mixed uniformly so that the fine particles are adhered to the surface of the magnetic resin carrier, and a mechanical impact and/or a thermal impact are then applied thereto so that the fine particles are driven into the magnetic resin carrier so as to be fixed thereon. In this case, the fine particles are not completely buried into the magnetic resin carrier, but fixed thereon with one portion thereof sticking out of the magnetic resin carrier surface. With respect to the chargeable fine particles, organic and inorganic insulating materials may be used. Specific examples of the organic-type include organic insulating fine particles of polystyrene, styrene-based copolymer, acrylic resin, various acrylic copolymers, nylon, polyethylene, polypropylene and fluororesin and crosslinked materials thereof, and with respect to the charging level and the polarity, by properly adjusting materials, polymerizing catalyst, surface treatment and the like, it is possible to obtain a desired charging level and a desired polarity. Specific examples of the inorganic-type include: negatively chargeable inorganic fine particles, such as silica and titanium oxide, and positively chargeable inorganic fine particles such as strontium titanate and alumina.

The coat-type carrier has a structure in which a resin coat is formed on carrier core particles made of a magnetic material, and in the same manner as the binder-type carrier, positively or negatively chargeable fine particles may be anchored onto the carrier surface. The charging properties such as polarity of the coat-type carrier can be controlled by adjusting the kind of the surface coating layer and the chargeable fine particles, and the same material as that of the binder-type carrier may be used. In particular, with respect to the coat resin, the same resin as the binder resin of the binder-type carrier may be used.

Figure 4:
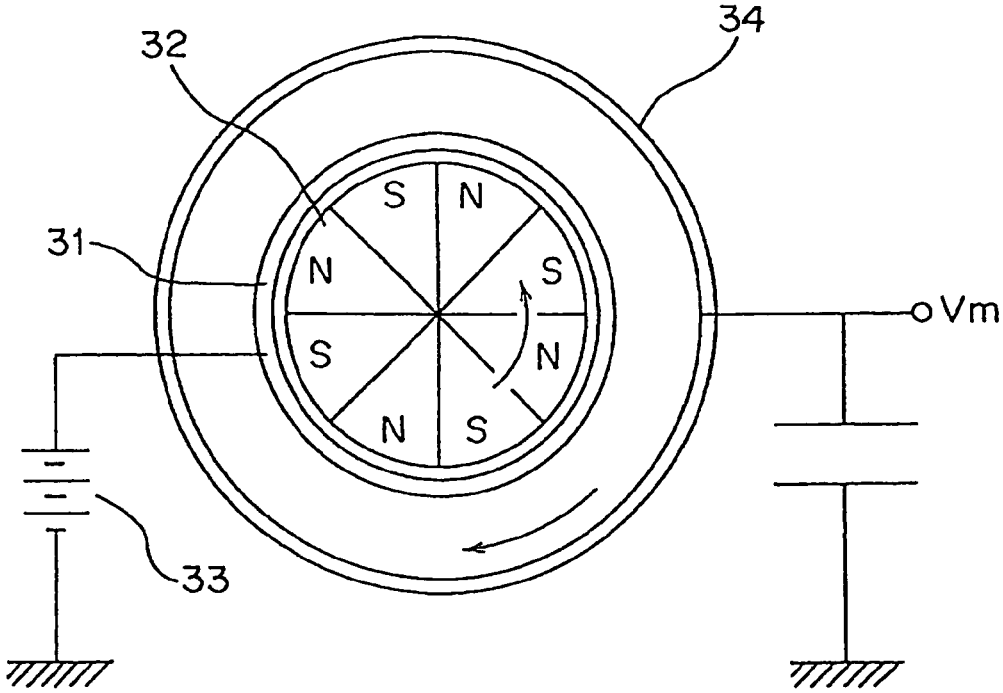
FIG. 4 is a schematic diagram that shows a measuring device of quantity of charge.

With respect to the electrostatic charge polarity of the toner and the reverse polarity particles in the combination with the reverse polarity particles, the toner and the carrier, after these materials have been mixed and stirred to form a developer, it is easily known by the direction of an electric field for separating the toner or the reverse polarity particles from the developer by using a device shown in FIG. 4.

The mixing ratio of the toner and the carrier is adjusted so as to obtain a desired quantity of charge in toner. The toner ratio is usually set in the range from 3 to 50% by weight, preferably from 6 to 30% by weight, with respect to the total amount of the toner and the carrier.

Not particularly limited as long as the objective of the present invention is achieved, in the case where the reverse polarity particles having a number average primary particle size in the range from 100 to 1000 nm, the amount of the reverse polarity particles contained in the developer is preferably set in the range from 0.01 to 5.00 parts by weight, more preferably from 0.01 to 2.00 parts by weight, with respect to the 100 parts by weight of the carrier. In the case where both the reverse polarity particles having a particle size distribution with a peak particle size of 0.8 to 1.5 μm and the second large particles, the amount of reverse polarity particles contained in the developer is set to 0.1 to 5.0% by mass, preferably 0.5 to 3.0% by mass, with respect to the toner. The amount of the second large particles, being not particularly limited as long as the objective of the present invention is achieved, is set to 0.01 to 5.0% by mass, preferably 0.1 to 2.0% by mass, with respect to the toner.

The developer is prepared, for example, through processes in which after externally adding the reverse polarity particles to the toner, the resulting toner is mixed with the carrier.

In the developing device 2*a*, a reverse polarity particle-collecting member 22, which separates the reverse polarity particles from the developer 24 supported on the developer-supporting member 11 and collects the resulting reverse polarity particles, is adopted as a separating mechanism that separates the toner or the reverse polarity particles from the developer 24 supported on the developer-supporting member 11. As shown in FIG. 1, the reverse polarity collecting member 22 is installed on the upstream side of a developing area 6 in the developer shifting direction on the developer-supporting member 11 so that upon application of a reverse polarity particle separating bias thereto, it allows the reverse polarity particles in the developer 24 to be electrically separated and collected on the surface of the reverse polarity particle-collecting member 22. After the reverse polarity particles have been separated by the reverse polarity particle-collecting member 22, the remaining developer 24 on the developer-supporting member 11, that is, the toner and the carrier, is successively transported and used for developing an electrostatic latent image on the image supporting member 1 at the developing area 6.

A predetermined reverse polarity particle separating bias is applied to the reverse polarity particle-collecting member 22 that is connected to a power supply (not shown) so that the reverse polarity particles in the developer 24 are electrically separated and collected on the surface of the reverse polarity particle-collecting member 22.

The reverse polarity particle separating bias to be applied to the reverse polarity particle-collecting member 22 is different depending on the electrostatic charge polarity of the reverse polarity particles; in other words, in the case when the toner is negatively charged with the reverse polarity particles being positively charged, the bias is a voltage having an average value lower than the average value of a voltage to be applied to the developer-supporting member 11, while in the case when the toner is positively charged with the reverse polarity particles being negatively charged, the bias voltage is a voltage having an average value higher than the average value of a voltage to be applied to the developer-supporting member 11. When the reverse polarity particles are charged to any of the positive polarity and the negative polarity, the difference between the average voltage to be applied to the reverse polarity particle-collecting member 22 and the average voltage to be applied to the developer-supporting member 11 is preferably set in the range from 20 to 500 V, particularly from 50 to 300 V. When the potential difference is too small, it becomes difficult to sufficiently collect the reverse polarity particles. In contrast, when the potential difference is too large, the carrier that is kept on the developer-supporting member 11 through a magnetic force is separated by an electric field, with the result that the inherent developing function in the developing area 6 tends to be impaired.

In the developing device 2*a*, an AC electric field is preferably formed between the reverse polarity particle-collecting member 22 and the developer-supporting member 11. The formation of the AC electric field allows the toner to reciprocally vibrate to effectively separate the reverse polarity particles adhering to the toner surface, making it possible to improve the collecting property of the reverse polarity particles. At this time, an electric field of $2.5\times10^6$ V/m or more is preferably formed. By forming the electric field of $2.5\times10^6$ V/m or more, it becomes possible to separate the reverse polarity particles also by using the electric field, and consequently to further improve the separating and collecting properties of the reverse polarity particles.

In the present specification, the electric field formed between the reverse particle collecting member 22 and the developer-supporting member 11 is referred to as a reverse polarity particle-separating electric field. Such a reverse polarity particle-separating electric field is normally obtained by applying an AC voltage to either the reverse polarity particle-collecting member 22 or the developer-supporting member 11 or to both of the members. In particular, in the case when an AC voltage is applied to the developer-supporting member 11 so as to develop the electrostatic latent image by the toner, it is preferable to form the reverse polarity particle-separating electric field by utilizing the AC voltage applied to the developer-supporting member 11. At this time, the maximum value in the absolute value of the reverse polarity particle-separating electric field is preferably set within the above-mentioned range.

For example, when the electrostatic charge polarity of the reverse polarity particles is positive and when a DC voltage and an AC voltage are applied to the developer-supporting member 11, with only a DC voltage being applied to the reverse polarity particle-collecting member 22, only the DC voltage that is lower than the average value of the voltage (DC+AC) to be applied to the developer-supporting member 11 is applied to the reverse polarity particle-collecting member 22. For another example, when the electrostatic charge polarity of the reverse polarity particles is negative and when a DC voltage and an AC voltage are applied to the developer-supporting member 11, with only a DC voltage being applied to the reverse polarity particle-collecting member 22, only the DC voltage that is higher than the average value of the voltage (DC+AC) to be applied to the developer-supporting member 11 is applied to the reverse polarity particle-collecting member 22. In these cases, the maximum value in the absolute value of the reverse polarity particle-separating electric field is defined as a value obtained by dividing the maximum value in the potential difference between the voltage (DC+AC) to be applied to the developer-supporting member 11 and the voltage (DC) to be applied to the reverse polarity particle-collecting member 22 by the gap of the closest point between the reverse polarity particle-collecting member 22 and the developer-supporting member 11, and the corresponding value is preferably set in the above-mentioned range.

For another example, when the electrostatic charge polarity of the reverse polarity particles is positive and when only a DC voltage is applied to the developer-supporting member 11, with an AC voltage and a DC voltage being applied to the reverse polarity particle-collecting member 22, a DC voltage on which an AC voltage is superposed so as to have an average voltage lower than the DC voltage applied to the developer-supporting member 11 is applied to the reverse polarity particle-collecting member 22. Furthermore, for example, when the electrostatic charge polarity of the reverse polarity particles is negative and when only a DC voltage is applied to the developer-supporting member 11, with an AC voltage and a DC voltage being applied to the reverse polarity particle-collecting member 22, a DC voltage on which an AC voltage is superposed so as to have an average voltage higher than the DC voltage applied to the developer-supporting member 11 is applied to the reverse polarity particle-collecting member 22. In these cases, the maximum value in the absolute value of the reverse polarity particle-separating electric field is defined as a value obtained by dividing the maximum value in the potential difference between the voltage (DC) to be applied to the developer-supporting member 11 and the voltage (DC+AC) to be applied to the reverse polarity particle-collecting member 22 by the gap of the closest point between the reverse polarity particle-collecting member 22 and the developer-supporting member 11, and the corresponding value is preferably set in the above-mentioned range.

For another example, when the electrostatic charge polarity of the reverse polarity particles is positive and when a DC voltage on which an AC voltage is superposed is applied to both of the developer-supporting member 11 and the reverse polarity particle-collecting member 22, a voltage (DC+AC) having an average voltage smaller than the average voltage of a voltage (DC+AC) to be applied to the developer-supporting member 11 is applied to the reverse polarity particle-collecting member 22. Moreover, for example, when the electrostatic charge polarity of the reverse polarity particles is negative and when a DC voltage on which an AC voltage is superposed is applied to both of the developer-supporting member 11 and the reverse polarity particle-collecting member 22, a voltage (DC+AC) having an average voltage greater than the average voltage of a voltage (DC+AC) to be applied to the developer-supporting member 11 is applied to the reverse polarity particle-collecting member 22. In these cases, the maximum value in the absolute value of the reverse polarity particle-separating electric field is defined as a value obtained by dividing the maximum value in the potential difference between the voltage (DC+AC) to be applied to the developer-supporting member 11 and the voltage (DC+AC) to be applied to the reverse polarity particle-collecting member 22, caused by differences in the amplitudes, phases, frequencies, duty ratios and the like between the AC voltage components respectively applied, by the gap of the closest point between the reverse polarity particle-collecting member 22 and the developer-supporting member 11, and the corresponding value is preferably set in the above-mentioned range.

The reverse polarity particles separated and collected on the surface of the reverse polarity particle-collecting member 22 are collected in the developer tank 16. Upon collecting the reverse polarity particles from the reverse polarity particle-collecting member 22 into the developer tank 16, the large-small size relationship between the average value of the voltage to be applied to the reverse polarity particle-collecting member 22 and the average value of the voltage to be applied to the developer-supporting member 11 is inverted, and this process is carried out at the time of non-image forming states, such as before the image forming process, after the image forming process and gaps between paper supplies (a page gap between the preceding page and the succeeding page) between image-forming processes during continuous operations.

With respect to the material for the reverse polarity particle-collecting member 22, any material may be used as long as the above-mentioned voltage can be applied, and for example, an aluminum roller subjected to a surface treatment may be used. In addition to this, a member prepared by forming a resin coating or a rubber coating on a conductive base member such as aluminum by using the following materials may be used: Examples of the resin include: polyester resin, polycarbonate resin, acrylic resin, polyethylene resin, polypropylene resin, urethane resin, polyamide resin, polyimide resin, polysulfone resin, polyether ketone resin, vinyl chloride resin, vinyl acetate resin, silicone resin and fluororesin, and examples of the rubber include: silicone rubber, urethane rubber, nitrile rubber, natural rubber and isoprene rubber. The coating material is not intended to be limited by these. A conductive agent may be added to the bulk or the surface of the above-mentioned coating. With respect to the conductive agent, an electron conductive agent or an ion conductive agent may be used. With respect to the electron conductive agent, although not particularly limited by these, carbon black, such as Ketchen Black, Acetylene Black and Furnace Black, and fine particles of metal powder and metal oxide, may be used. With respect to the ion conductive agent, although not particularly limited by these, cationic compounds such as quaternary ammonium salts, amphoteric compounds and other ionic polymer materials are listed. A conductive roller made of a metal material such as aluminum may be used.

The developer-supporting member 11 is constituted by a magnetic roller 13 fixedly placed and a sleeve roller 12 that is freely rotatable and encloses the magnetic roller 13. The magnetic roller 13 has five magnetic poles N1, S1, N3, N2 and S2 placed along the rotation direction B of the sleeve roller 12. Among these magnetic poles, the main magnetic pole N1 is placed at a position of the developing area 6 facing the image supporting member 1, and identical pole sections N3 and N2, which generate a repulsive magnetic field for separating the developer 24 on the sleeve roller 12, are placed at opposing positions inside the developing tank 16.

The developer tank 16 is formed by a casing 18, and normally, houses a bucket roller 17 for supplying the developer 24 to the developer-supporting member 11 therein. At a position facing the bucket roller 17 of the casing 18, an ATDC (Automatic Toner Density Control) sensor 20 for detecting the toner density is preferably placed.

The developing device 2*a* is normally provided with a supplying unit 7 for supplying toner to be consumed in the developing area 6 into the developer tank 16, and a regulating member (regulating blade) 15 for regulating the developer layer so as to regulate the amount of developer 24 on the developer supporting member 11. The supplying unit 7 is constituted by a hopper 21 housing supply toner 23 and a supplying roller 19 for supplying the supply toner 23 into the developer tank 16.

With respect to the supply toner 23, a toner to which reverse polarity particles have been externally added is preferably used. By using the toner to which reverse polarity particles have been externally added, it is possible to effectively compensate for a reduction in the charge property of the carrier that gradually deteriorates through a long-term use. In the case where the reverse polarity particles having a number average primary particle size in the range from 100 to 1000 nm, the amount of the externally added reverse polarity particles in the supply toner 23 is preferably set in the range from 0.1 to 10.0% by weight, particularly from 0.5 to 5.0% by weight. In the case where both the reverse polarity particles having a particle size distribution with a peak particle size of 0.8 to 1.5 μm and the second large particles, the amount of reverse polarity particles contained in the developer 24 is set to 0.1 to 5.0% by mass, preferably to 0.5 to 3.0% by mass, with respect to the toner. The amount of the second large particles, being also not particularly limited as long as the objective of the present invention, is set to 0.01 to 5.0% by mass, preferably to 0.1 to 2.0% by mass, with respect to the toner.

More specifically, in the developing device 2*a* shown in FIG. 1, the developer 24 inside the developer tank 16 is mixed and stirred by rotation of the bucket roller 17, and after having been friction-charged, scooped by the bucket roller 17 to be supplied to the sleeve roller 12 on the surface of the developer-supporting member 11. The developer 24 is maintained on the surface side of the sleeve roller 12 by a magnetic force of the magnetic roller 13 inside the developer-supporting member (developing roller) 11, and rotated and shifted together with the sleeve roller 12, with the transmitting amount being regulated by the regulating member 15 placed face to face with the developing roller 11. Thereafter, at the portion facing the reverse polarity particle-collecting member 22, only the reverse polarity particles contained in the developer 24 are separated and collected by the reverse polarity particle-collecting member 22 as described earlier. The remaining developer from which the reverse polarity particles have been separated is transported to the developing area 6 facing the image supporting member 1. At the developing area 6, raised and aligned particles of the developer 24 are formed by a magnetic force of the main magnetic pole N1 of the magnetic roller 13, and an electric field, formed between an electrostatic latent image on the image supporting member 1 and the developing roller 11 to which a developing bias is applied, gives a force to the toner so that the toner in the developer 24 is moved to the electrostatic latent image side on the image supporting member 1; thus, the electrostatic latent image is developed into a visible image. The developing system may be an inversion developing system or may be a regular developing system. The developer 24 the toner of which has been consumed in the developing area 6 is transported toward the developer tank 16, and separated from the developer-supporting member 11 by a repulsive magnetic field of the identical pole sections N3 and N2 of the magnetic roller 13 that are aligned face to face with the bucket roller 17, and collected into the developing tank 16. Upon detecting that the toner density in the developer 24 has become lower than the minimum toner density required for maintaining the image density from an output value of the ATDC sensor 20, a supply controlling unit, not shown, installed in the supplying unit 7, sends a driving start signal to the driving means of the toner supplying roller 19. Thus, the rotation of the toner supplying roller 19 is started, and by the rotation, the supply toner 23 stored in the hopper 21 is supplied into the developer tank 16. The reverse polarity particles, collected by the reverse polarity particle-collecting member 22, are returned onto the developing roller 11 by inverting the direction of an electric field to be applied to the developing roller 11 and the reverse polarity particle-collecting member 22 in the non-image forming state, and then transported together with the developer 24, following the rotation of the developing roller 11 to be returned into the developer tank 16.

In FIG. 1, the reverse polarity particle-collecting member 22 is installed in a separate manner from the regulating member 15 in a casing 26; however, the reverse polarity particle-collecting member 22 may be designed to also serve as at least either one of the regulating member 15 and the casing 26. In other words, the regulating member 15 and/or the casing 26 may be used as the reverse polarity particle-collecting member 22. In such a case, a reverse polarity particle separating bias may be applied to the regulating member 15 and/or the casing 26. With this arrangement, it becomes possible to save space and achieve low costs.

In the developing device 2*a*, all the reverse polarity particles are not necessarily required to be collected by the reverse polarity particle-collecting member 22, and one portion of the reverse polarity particles, which have not been collected, may be supplied together with the toner to the developing process, and consumed therein. The reverse polarity particles of the other portion are collected and reverse polarity particles are also supplied, so that the carrier charge-assisting effect by the reverse polarity particles can be obtained even when the reverse polarity particles are not completely collected.

Figure 2:
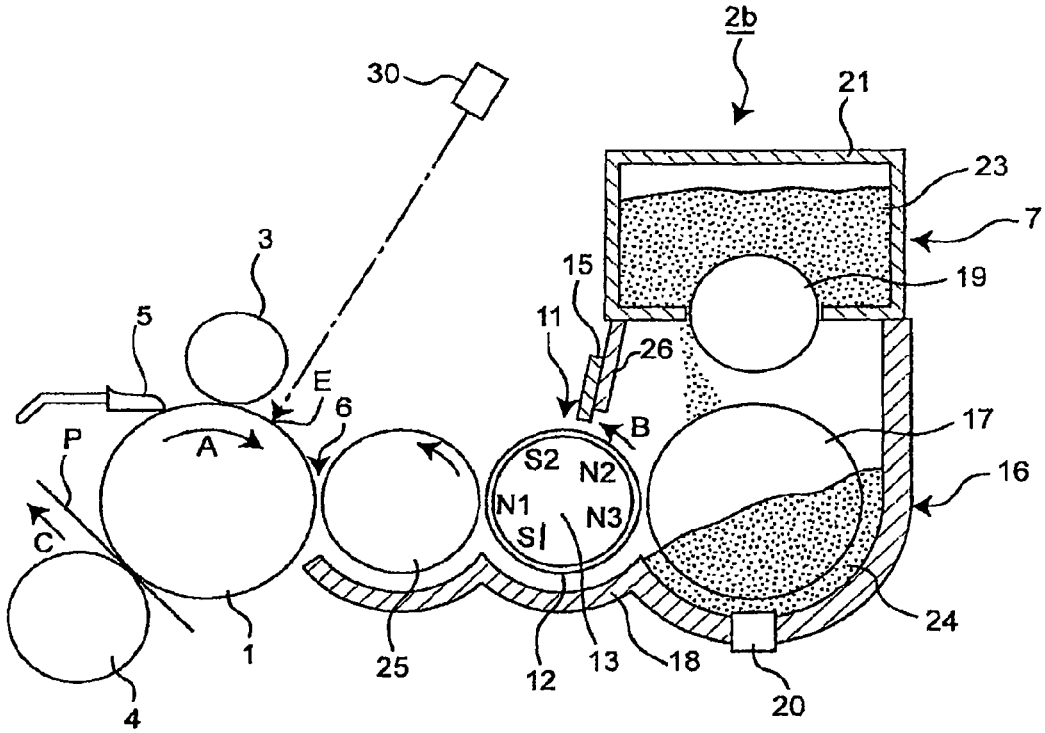
FIG. 2 is a schematic diagram that shows a main portion of the image-forming apparatus in accordance with another embodiment of the present invention.

FIG. 2 shows a main portion of an image-forming apparatus in accordance with another embodiment of the present invention. In FIG. 2, those members having the same functions as those shown in FIG. 1 are indicated by the same reference numerals, and the detailed description thereof is omitted.

In a developing device 2*b* shown in FIG. 2, in place of the reverse polarity particle-collecting member 22 shown in FIG. 1, a toner-supporting member 25 that separates toner from the developer 24 supported on the developer-supporting member 11 and supports the toner is used as the separating mechanism that separates toner or reverse polarity particles from the developer 24 supported on the developer-supporting member 11. As shown in FIG. 2, the toner-supporting member 25 is placed between the developer-supporting member 11 and the image supporting member 1, and is designed so that upon application of a toner separating bias thereto, the toner in the developer 24 is electrically separated and supported on the surface of the toner-supporting member 25. The toner, separated by the toner-supporting member 25 and supported thereon, is transported by the toner-supporting member 25, and used for developing an electrostatic latent image on the image supporting member 1 at the developing area 6.

As described above, different from the embodiment shown in FIG. 1, the developing device 2*b* does not separate reverse polarity particles from the developer 24, but allows the toner-supporting member 25 to separate the toner from the developer 24 and support the toner thereon, and the toner, separated and supported on the toner-supporting member 25, is used for developing an electrostatic latent image on the image supporting member 1.

The toner-supporting member 25 is connected to a power supply (not shown) and a predetermined toner-separating bias is applied thereto so that the toner in the developer 24 is electrically separated and supported on the surface of the toner-supporting member 25.

The toner separating bias to be applied to the toner-supporting member 25 is different depending on the electrostatic charge polarity of the toner; in other words, when the toner is negatively charged, a voltage having an average voltage higher than the average value of a voltage to be applied to the developer-supporting member 11 is applied. When the toner is positively charged, a voltage having an average voltage lower than the average value of a voltage to be applied to the developer-supporting member 11 is charged. In either of the cases when the toner is positively charged and when the toner is negatively charged, the difference between the average voltage to be applied to the toner-supporting member 25 and the average voltage to be applied to the developer-supporting member 11 is preferably set in the range from 20 to 500 V, particularly from 50 to 300 V. When the difference in the electric potentials is too small, the amount of toner on the toner-supporting member 25 becomes small, failing to provide a sufficient image density. When the difference in the electric potentials is too great, the toner supply becomes excessive, resulting in an increase in wasteful toner consumption.

In the developing device 2*b*, an AC electric field is preferably formed between the toner-supporting member 25 and the developer-supporting member 11. Since the formation of the AC electric field allows the toner to reciprocally vibrate, it becomes possible to effectively separate the reverse polarity particles from the toner. In this case, an electric field of $2.5\times10^6$ V/m or more is preferably formed. By forming the electric field of $2.5\times10^6$ V/m or more, it becomes possible to separate reverse polarity particles from the toner also by the electric field, and consequently to further improve the separating property of the toner.

In the present specification, the electric field, formed between the toner-supporting member 25 and the developer-supporting member 11, is referred to as a toner-separating electric field. Such a toner-separating electric field is normally formed by applying an AC voltage to either the toner-supporting member 25 or the developer-supporting member 11, or to both of the toner-supporting member 25 and the developer-supporting member 11. In particular, when an AC voltage is applied to the toner-supporting member 25 so as to develop an electrostatic latent image by the toner, the toner-separating electric field is preferably formed by utilizing the AC voltage to be applied to the toner-supporting member 25. In this case, the maximum value in the absolute value of the toner-separating electric field is preferably set within the aforementioned range.

For example, when the toner charge polarity is positive, with a DC voltage and an AC voltage being applied to the developer-supporting member 11, and when only a DC voltage is applied to the toner-supporting member 25, only the DC voltage lower than the average value of the voltage (DC+AC) to be applied to the developer-supporting member 11 is applied to the toner-supporting member 25. For example, when the toner charge polarity is negative, with a DC voltage and an AC voltage being applied to the developer-supporting member 11, and when only a DC voltage is applied to the toner-supporting member 25, only the DC voltage higher than the average value of the voltage (DC+AC) to be applied to the developer-supporting member 11 is applied to the toner-supporting member 25. In these cases, the maximum value in the absolute value of the toner-separating electric field is given by a value obtained by dividing the maximum value in the potential difference between the voltage (DC+AC) to be applied to the developer-supporting member 11 and the voltage (DC) to be applied to the toner-supporting member 25 by the gap of the closest point between the toner-supporting member 25 and the developer-supporting member 11, and the corresponding value is preferably set in the aforementioned range.

For another example, when the toner charge polarity is positive, with only a DC voltage being applied to the developer-supporting member 11, and when an AC voltage and a DC voltage are applied to the toner-supporting member 25, a DC voltage on which an AC electric field is superposed so as to form an average voltage lower than the DC electric field to be applied to the developer-supporting member 11 is applied to the toner-supporting member 25. For another example, when the toner charge polarity is negative, with only a DC voltage being applied to the developer-supporting member 11, and when an AC voltage and a DC voltage are applied to the toner-supporting member 25, a DC voltage on which an AC electric field is superposed so as to form an average voltage higher than the DC electric field to be applied to the developer-supporting member 11 is applied to the toner-supporting member 25. In these cases, the maximum value in the absolute value of the toner-separating electric field is given by a value obtained by dividing the maximum value in the potential difference between the voltage (DC) to be applied to the developer-supporting member 11 and the voltage (DC+AC) to be applied to the toner-supporting member 25 by the gap of the closest point between the toner-supporting member 25 and the developer-supporting member 11, and the corresponding value is preferably set in the aforementioned range.

For another example, when the toner charge polarity is positive, with a DC voltage on which an AC voltage is superposed being applied to each of the developer-supporting member 11 and the toner-supporting member 25, the voltage (DC+AC) having an average voltage smaller than the average voltage of a voltage (DC+AC) to be applied to the developer-supporting member 11 is applied to the toner-supporting member 25. For another example, when the toner charge polarity is negative, with a DC voltage on which an AC voltage is superposed being applied to each of the developer-supporting member 11 and the toner-supporting member 25, the voltage (DC+AC) having an average voltage larger than the average voltage of a voltage (DC+AC) to be applied to the developer-supporting member 11 is applied to the toner-supporting member 25. In these cases, the maximum value in the absolute value of the toner-separating electric field is given by a value obtained by dividing the maximum value in the potential difference between the voltage (DC+AC) to be applied to the developer-supporting member 11 and the voltage (DC+AC) to be applied to the toner-supporting member 25 that is caused by differences in the amplitudes, phases, frequencies, duty ratios and the like between the AC voltage components respectively applied by the gap of the closest point between the toner-supporting member 25 and the developer-supporting member 11, and the corresponding value is preferably set in the above-mentioned range.

The remaining developer on the developer-supporting member 11 from which the toner has been separated by the toner-supporting member 25, that is, the carrier and reverse polarity particles, as they are, are transported by the developer-supporting member 11, and collected in the developer tank 16. In the present embodiment, after the separation of the toner, the reverse polarity particles, as they are, are collected in the developer tank 16 by the developer-supporting member 11; therefore, the process, used for returning the reverse polarity particles collected by the reverse polarity particle-collecting member 22 to the developer tank 16 during a non-image forming process, explained in the embodiment of FIG. 1, can be omitted.

With respect to the toner-supporting member 25, any material may be used as long as the above-mentioned voltage can be applied, and, for example, an aluminum roller that has been subjected to a surface treatment may be used. In addition to this, a member prepared by forming a resin coating or a rubber coating on a conductive base member such as aluminum by using the following materials may be used: Examples of the resin include: polyester resin, polycarbonate resin, acrylic resin, polyethylene resin, polypropylene resin, urethane resin, polyamide resin, polyimide resin, polysulfone resin, polyether ketone resin, vinyl chloride resin, vinyl acetate resin, silicone resin and fluororesin, and examples of the rubber include: silicone rubber, urethane rubber, nitrile rubber, natural rubber and isoprene rubber. The coating material is not intended to be limited by these. A conductive agent may be added to the bulk or the surface of the above-mentioned coating. With respect to the conductive agent, an electron conductive agent or an ion conductive agent may be used. With respect to the electron conductive agent, although not particularly limited by these, carbon black, such as Ketchen Black, Acetylene Black and Furnace Black, and fine particles of metal powder and metal oxide, may be used. With respect to the ion conductive agent, although not particularly limited by these, cationic compounds such as quaternary ammonium salts, amphoteric compounds and other ionic polymer materials are listed. A conductive roller made of a metal material such as aluminum may be used.

More specifically, in the developing device **2*b* shown in FIG. 2, in the same manner as the developing device 2*a*, the developer 24 inside the developer tank 16 is mixed and stirred by rotation of the bucket roller 17, and after having been friction-charged, scooped by the bucket roller 17 to be supplied to the sleeve roller 12 on the surface of the developer-supporting member 11. The developer 24 is maintained on the surface side of the sleeve roller 12 by a magnetic force of the magnetic roller 13 inside the developer-supporting member (developing roller) 11, and rotated and shifted together with the sleeve roller 12, with the transmitted amount being regulated by the regulating member 15 placed face to face with the developing roller 11. Thereafter, at the portion facing the toner-supporting member 25, only the toner contained in the developer 24 is separated and supported on the toner-supporting member 25, as described earlier. The toner, thus separated, is transported to the developing area 6 facing the image supporting member 1. At the developing area 6, the toner on the toner-supporting member 25 is moved toward the electrostatic latent image side on the image supporting member 1 through a force applied to the toner by an electric field formed between the electrostatic latent image on the image supporting member 1 and the toner-supporting member 25 to which a developing bias is applied so that the electrostatic latent image is developed into a visible image. The developing system may be an inversion developing system or may be a regular developing system. The toner layer on the toner-supporting member 25, which has passed through the developing area 6, is subjected to toner supplying and collecting processes by a magnetic brush in a portion at which the toner-supporting member 25 and the developer-supporting member 11 are made face to face with each other, and then transported to the developing area 6. In contrast, the remaining developer on the developer-supporting member 11 from which the toner has been separated, as it is, is transported to the developer tank 16, and separated from the developer-supporting member 11 by a repulsive magnetic field of the identical pole units N3 and N2 of the magnetic roller 13 that are aligned face to face with the bucket roller 17, and then collected into the developer tank 16. In the same manner as shown in FIG. 1, upon detecting that the toner density in the developer 24 has become lower than the minimum toner density required for maintaining the image density, a supply controlling unit, not shown, installed in the supplying unit 7, sends a driving start signal to the driving means of the toner supplying roller 19 so that supply toner 23 is supplied into the developer tank 16**.

In the developing device 2*b*, all the reverse polarity particles are not necessarily required to be collected by the reverse polarity particle-collecting member 22, and one portion of the reverse polarity particles, which have not been collected, may be supplied together with the toner to the developing process, and consumed therein. The reverse polarity particles of the other portion are collected and reverse polarity particles are also supplied, so that the carrier charge-assisting effect by reverse polarity particles can be obtained even when the reverse polarity particles are not completely collected.

The reverse polarity particle-collecting member 22 installed in the developing device 2*a*, indicated in the embodiment shown in FIG. 1, may also be installed in the developing device 2*b* so that the reverse polarity particle collecting property can be further improved.

EXAMPLES

Test Example 1

Toners obtained from the following methods were used.

Toner A:

To toner base material (100 parts by weight) having a volume average particle size of about 6.5 μm, formed by a wet granulation method, were externally added first hydrophobic silica (0.2 parts by weight), second hydrophobic silica (0.5 parts by weight) and hydrophobic titanium oxide (0.5 parts by weight) by carrying out a surface treatment at a rate of 40 m/s for 3 minutes by using a Henschel mixer (made by Mitsui Kinzoku Kozan Co., Ltd.) to obtain toner A.

The first hydrophobic silica to be used here was prepared by carrying out a surface treatment on silica (#130: made by Nippon Aerosil K.K.) having a number average primary particle size of 16 nm by using hexamethyldisilazane (HMDS) serving as a hydrophobicity-applying agent. The second hydrophobic silica was prepared by carrying out a surface treatment on silica (#90G: made by Nippon Aerosil K.K.) having a number average primary particle size of 20 nm by using HMDS. The hydrophobic titanium oxide was prepared by carrying out a surface treatment on anatase-type titanium oxide having a number average primary particle size of 30 nm in an aqueous wet system by using isobutyl trimethoxysilane serving as a hydrophobicity-applying agent.

Toner B:

To toner A was added strontium titanate having a number average primary particle size of 350 nm serving as reverse polarity particles at a rate of 2 parts by weight to 100 parts by weight of the toner base material particles contained in toner A, through an externally applying treatment by using the Henschel at a rate of 40 m/s for 3 minutes to obtain toner B.

Toner C:

To toner A was added strontium titanate having a number average primary particle size of 350 nm serving as reverse polarity particles at a rate of 2 parts by weight to 100 parts by weight of the toner base material particles contained in toner A, through an externally applying treatment by using the Henschel at a rate of 30 m/s for 1 minutes to obtain toner C.

Example 1

A developing device having a structure shown in FIG. 1 was used, and with respect to a developer, carrier (volume average particle size: about 33 μm) for bizhub C350 (made by Konica Minolta Business Technologies, Inc.) and toner B were used. The toner ratio in the developer was set to 8% by weight. The toner ratio was defined as a rate of the total amount of the toner, post-treatment agents and reverse polarity particles to the entire amount of the developer (the same is true in the following description). To a developer-supporting member was applied a developing bias with a rectangular wave having an amplitude of 1.4 kV, a DC component of −400 V, a Duty ratio of 50% and a frequency of 2 kHz. A DC bias of −550 V, which had a potential difference of −150 V from the average potential of the developing bias and a potential difference of 850 V from the maximum potential of the developing bias, was applied to a reverse polarity particle-collecting member. With respect to the reverse polarity particle-collecting member, an aluminum roller the surface of which was alumite-treated was used, and a gap at the closest point between the developer-supporting member and the reverse polarity particle-collecting member was set to 0.3 mm. The background portion potential of an electrostatic latent image formed on the image supporting member was −550 V and the image portion potential thereof was −60 V. A gap at the closest point between the image supporting member and the developer-supporting member was set to 0.35 mm. The greatest value of the absolute value of a reverse polarity particle-separating electric field formed between the reverse polarity particle-collecting member and the developer-supporting member was 850 V/0.3 mm=$2.8\times10^6$ V/m. The recovering operation of the reverse polarity particles collected in the reverse polarity particle-collecting member into the developer tank was carried out by reversing voltages to be applied to the developer-supporting member and the reverse polarity particle-collecting member in synchronized timing between copy sheets.

Example 2

In Example 1, the reverse polarity particle-collecting member was removed, and a developing device in which a regulating member also functions as the reverse polarity particle-collecting member was used. To the developer-supporting member was applied a developing bias with a rectangular waveform having an amplitude of 1.4 kV, a DC component of −400 V, a Duty ratio of 50% and a frequency of 2 kHz. A DC bias of −700 V, which had a potential difference of −300 V from the average potential of the developing bias and a potential difference of 1000 V from the maximum potential of the developing bias, was applied to the regulating member. The regulating member was made of stainless steel (SUS430). A gap at the closest point between the developer-supporting member and the regulating member was set to 0.4 mm. The background portion potential of an electrostatic latent image formed on the image supporting member was −550 V and the image portion potential thereof was −60 V. A gap at the closest point between the image supporting member and the developer-supporting member was set to 0.35 mm. The greatest value of the absolute value of an electric field formed between the regulating member (reverse polarity particle-collecting member) and the developer-supporting member was 1000 V/0.4 mm=$2.5\times10^6$ V/m. The recovering operation of the reverse polarity particles collected in the reverse polarity particle-collecting member into the developer tank was carried out by reversing voltages to be applied to the developer-supporting member and the reverse polarity particle-collecting member in synchronized timing between copy sheets.

Example 3

A developing device having a structure shown in FIG. 2 was used, and with respect to a developer, carrier (volume average particle size: about 33 μm) for bizhub C350 (made by Konica Minolta Business Technologies, Inc.) and toner C were used. The toner ratio in the developer was set to 8% by weight. To a developer-supporting member was applied a DC voltage of −400 V. To a toner-supporting member was applied a developing bias with a rectangular wave having an amplitude of 1.6 kV, a DC component of −300 V, a Duty ratio of 50% and a frequency of 2 kHz. With respect to the electric potential of the developer-supporting member, the average electric potential of the toner-supporting member had a potential difference of 100 V from the electric potential of the developer-supporting member, and the maximum potential difference was 900 V. With respect to the toner-supporting member, an aluminum roller the surface of which was alumite treated was used, and a gap at the closest point between the developer-supporting member and the toner-supporting member was set to 0.3 mm. The background portion potential of an electrostatic latent image formed on the image supporting member was −550 V and the image portion potential thereof was −60 V. A gap at the closest point between the image supporting member and the toner-supporting member was set to 0.15 mm. The greatest value of the absolute value of a toner-separating electric field formed between the toner-supporting member and the developer-supporting member was 900 V/0.3 mm=$3.0\times10^6$ V/m.

Example 4

A developing device having a structure shown in FIG. 2 was used, and with respect to a developer, carrier (volume average particle size: about 33 μm) for bizhub C350 (made by Konica Minolta Business Technologies, Inc.) and toner B were used. The toner ratio in the developer was set to 10% by weight. To a developer-supporting member was applied a DC voltage of −250 V. To a toner-supporting member was applied a developing bias formed by superposing a rectangular wave having an amplitude of 1.4 kV, a Duty ratio of 60% and a frequency of 4 kHz on a DC voltage of −300V. The average electric potential of the toner-supporting member was −160 V, and had a potential difference of 90 V from the electric potential of the developer-supporting member, and the maximum potential difference was 750 V. With respect to the toner-supporting member, an aluminum roller the surface of which was alumite treated was used, and a gap at the closest point between the developer-supporting member and the toner-supporting member was set to 0.3 mm. The background portion potential of an electrostatic latent image formed on the image supporting member was −550 V and the image portion potential thereof was −60 V, with a gap at the closest point between the image supporting member and the toner-supporting member being set to 0.15 mm. The greatest value of the absolute value of a toner-separating electric field formed between the toner-supporting member and the developer-supporting member was 750 V/0.3 mm=$2.5\times10^6$ V/m.

Comparative Example 1

A developing device having the same structure as Example 1 except that toner A was used as the toner was used.

Comparative Example 2

A developing device having the same structure as Example 3 except that toner A was used as the toner was used.

Comparative Example 3

A developing device that had the same structure as Example 1 except that the reverse polarity collecting member had been omitted was used.

By using the image forming apparatuses prepared by revising the copying machine bizhub C350 made by Konica Minolta Business Technologies, Inc., endurance tests of 50,000 copies were carried out by using an image chart with an image area rate of about 5% under respective conditions and the endurance was evaluated. The quantity of charge in toner of the developer sampled at each of points for endurance evaluation was measured and evaluated by using a device shown in FIG. 4, and the results are shown in Table 1. In any of the image forming apparatuses, with respect to the supplying toner, the toners of the respective Examples and Comparative Examples were used. The sampling of the developer was conducted from the developer tank.

The quantity of strontium titanate adhered to the carrier surface after the endurance tests of 50,000 copies was calculated based upon the quantity of strontium obtained through an ICP analysis, and quantitative-determined. With respect to the carrier, after the toner had been separated from the developer by using a device shown in FIG. 4, excessive adhered matters were removed from the carrier surface by applying ultrasonic vibration thereto in an aqueous solution to which a surfactant had been added, and the carrier was then subjected to an analyzing process. The value is given as a rate of strontium titanate to the carrier weight.

TABLE 1

| Number of copies | Quantity of charge in toner (−μC/g) Initial | 10k copies | 20k copies | 30k copies | 40k copies | 50k copies | Change in quantity of charge in toner (−μC/g) | Quantity of strontium titanate (wt %) |
|---|---|---|---|---|---|---|---|---|
| Example 1 | 33.1 | 30.5 | 33.0 | 31.6 | 30.9 | 32.8 | −0.3 | 0.08 |
| Example 2 | 34.2 | 32.1 | 33.6 | 32.9 | 32.8 | 32.4 | −1.8 | 0.03 |
| Example 3 | 32.5 | 32.8 | 33.1 | 33.6 | 34.2 | 33.7 | 1.2 | 0.12 |
| Example 4 | 30.1 | 28.8 | 29.1 | 28.4 | 28.2 | 26.8 | −3.3 | 0.01 |
| Comparative Example 1 | 35.3 | 27.3 | 26.8 | 24.5 | 23.2 | 22.5 | −12.8 | — |
| Comparative Example 2 | 35.9 | 26.0 | 22.3 | 21.0 | 20.8 | 19.5 | −16.4 | — |
| Comparative Example 3 | 33.6 | 27.5 | 27.0 | 25.4 | 25.9 | 25.5 | −8.1 | 0.007 |

Table 1 indicates that in Examples, there were only small changes in quantity of charge in toner between the initial state and the state after 50,000 copies had been made, while in any of Comparative Examples, there were changes in quantity of charge in toner that reached a level exceeding 7 μC/g. Moreover, in Examples, the quantity of strontium titanate adhered to the carrier surface after making 50,000 copies was maintained in a level of 0.01% by weight or more; in contrast, in Comparative Example 3, the quantity was far below the level of Examples, and in Comparative Examples 1 and 2 using toners containing no strontium titanate, nothing was detected.

Test Example 2

Figure 3:
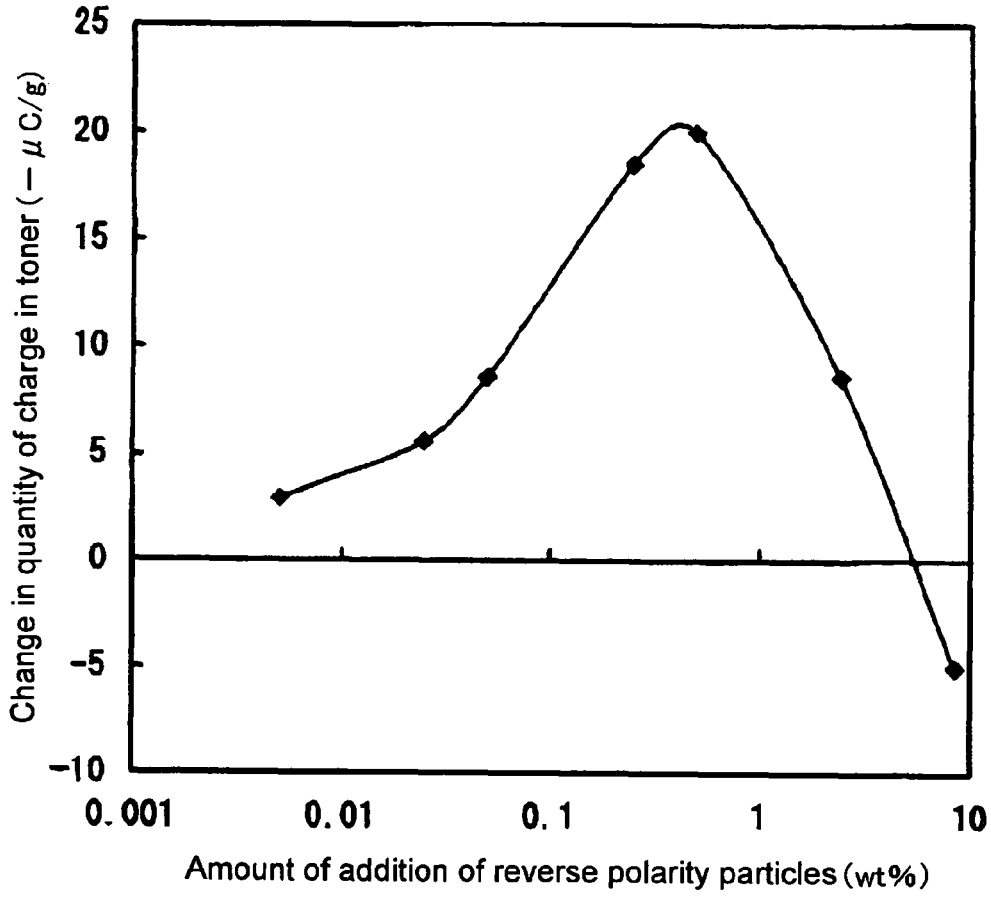
FIG. 3 is a graph that shows changes in the quantity of charge in toner to the amount of addition of reverse polarity particles to a carrier.

The carrier charge-assisting effect by reverse polarity particles and the range of effective amount of addition thereof were examined. FIG. 3 indicates the change in quantity of charge in toner to the amount of addition of reverse polarity particles to the carrier. Upon evaluation, a carrier for bizhub C350 made by Konica Minolta Business Technologies, Inc. was used, and the carrier was preliminarily subjected to a pre-treatment to add strontium titanate serving as reverse polarity particles thereto with varied amounts of addition. The toner for the above-mentioned bizhub C350 was mixed with each of carriers having different amounts of addition of reverse polarity particles so as to have a toner weight ratio of 8%, so that a developer was prepared. With respect to the respective carriers having different amounts of the reverse polarity particles treated thereon, measurements on the quantity of charge in toner by using a device shown in FIG. 4 so that a difference (amount of change) from the quantity of charge in toner of a developer using a carrier that has not been subjected to treatments with reverse polarity particles was found. With respect to the measurements on the quantity of charge in toner, a developer the weight of which had been measured was placed on the entire surface of a conductive sleeve 31 uniformly, and the number of revolutions of a magnet roll 32, installed inside the conductive sleeve 31, was set to 1000 rpm. Then, a bias voltage of 2 kV with a polarity reversed to that of the toner charging potential was applied from a bias power supply 33, and the conductive sleeve 31 was rotated for 15 seconds; thus, the electric potential Vm of a cylinder electrode 34 at the time when the conductive sleeve 31 was stopped was read, and the weight of toner adhered to the cylinder electrode 34 was measured by using a precision balance so that the quantity of charge in toner was found. FIG. 3 shows that by allowing the reverse polarity particles to adhere to the carrier, the quantity of charge in toner is increased. The charge-assisting effect of the carrier by the reverse polarity particles is obtained even by an addition of an extremely small amount thereof, and the effect is improved in response to an increase in the amount of addition. As the amount of addition further increases, the effect of the reverse polarity particles is changed to degrease, and when the amount of addition exceeds about 2% by weight, the effect is no longer exerted. The reduction of the effect at the time of much amount of addition is considered to be caused by the fact that due to the much amount of the reverse polarity particles, it becomes difficult to maintain the reverse polarity particles on the carrier surface, with the result that excessive reverse polarity particles are moved together with the toner to cancel the charge of the toner. Based on the above-mentioned facts, in the case when strontium titanate is used as the reverse polarity particles, the amount of adhesion of reverse polarity particles to the carrier surface is preferably set in the range from 0.01% by weight to 2% by weight in order to a sufficient carrier charge-assisting effect. Here, the amount of addition of the reverse polarity particles is indicated by a rate to the amount of the carrier.

Test Example 3

Figure 5:
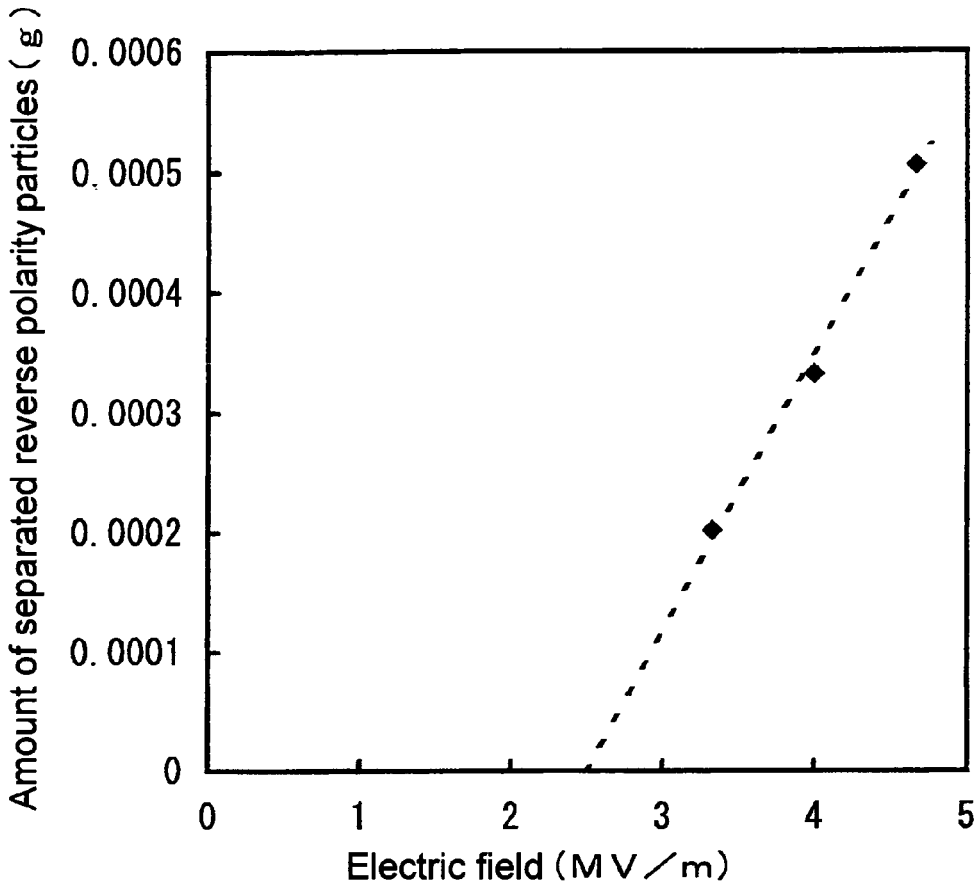
FIG. 5 is a graph that shows changes in the amount of separated reverse polarity particles from toner due to an electric field.
Figure 6:
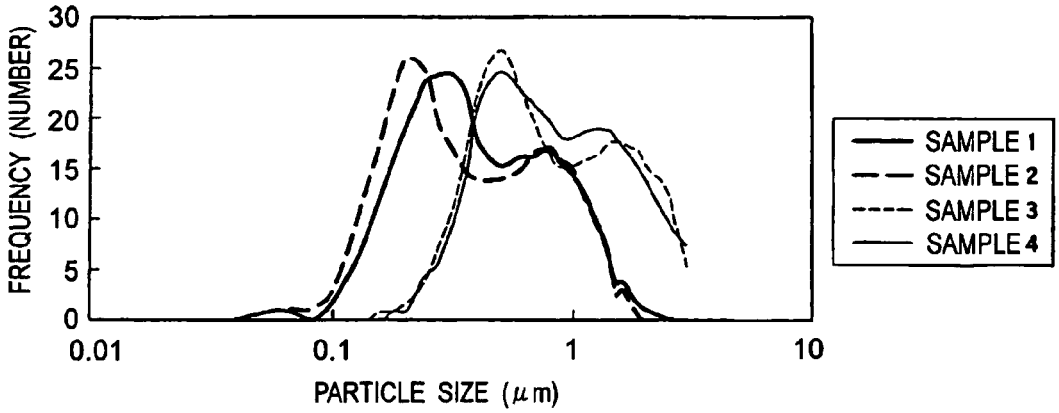
FIG. 6 is the results of measurements on particle size distribution of samples 1 to 4.
Figure 7:
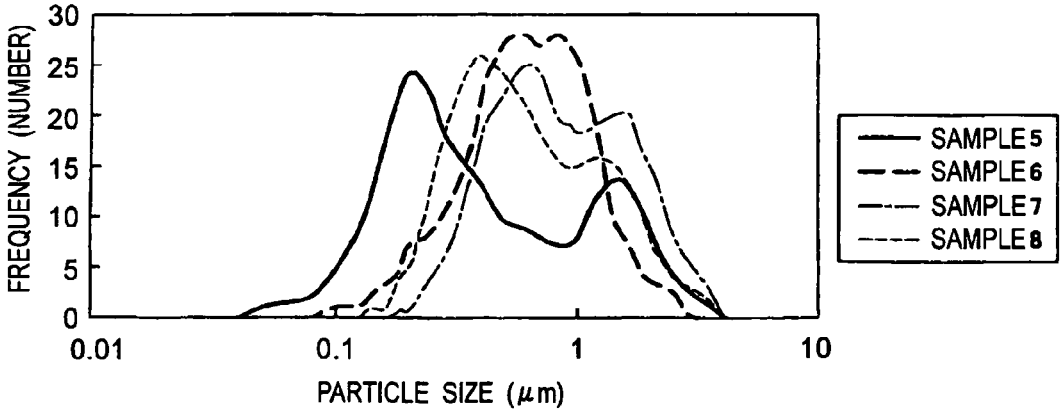
FIG. 7 is the results of measurements on particle size distribution of samples 5 to 8.
Figure 8:
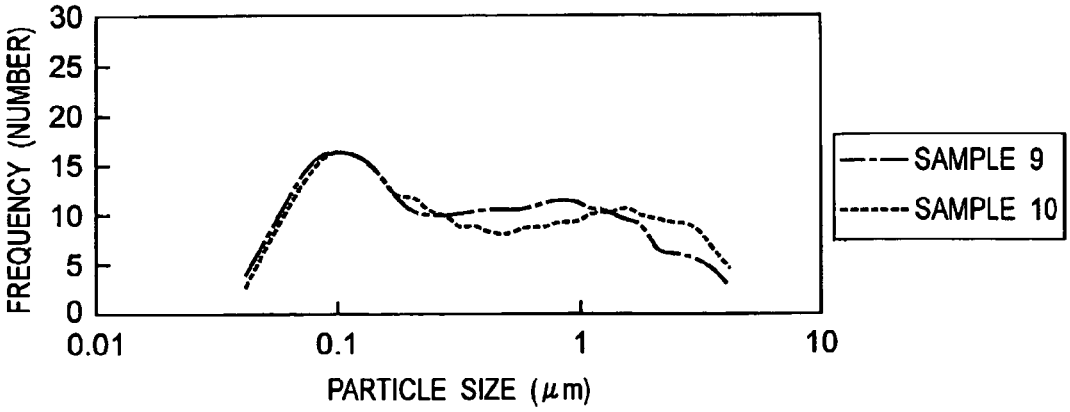
FIG. 8 is the results of measurements on particle size distribution of samples 9 to 10.
Figure 9:
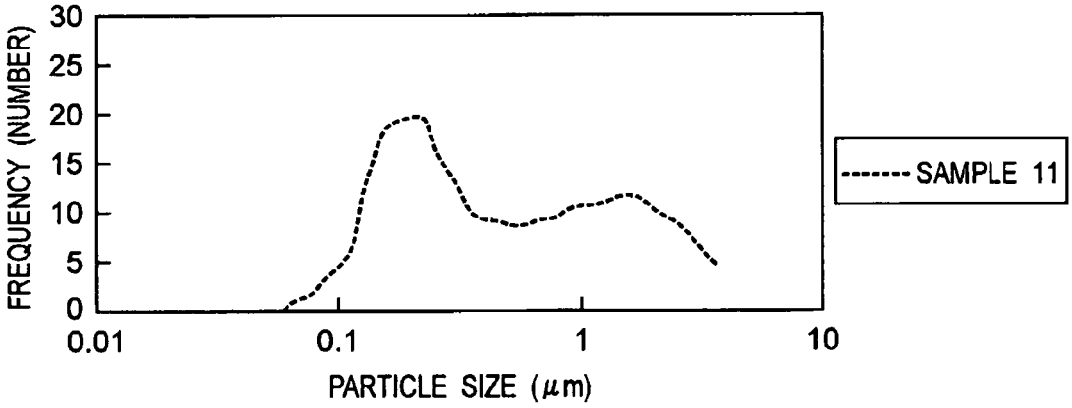
FIG. 9 is the results of measurements on particle size distribution of sample 11.
Figure 10:
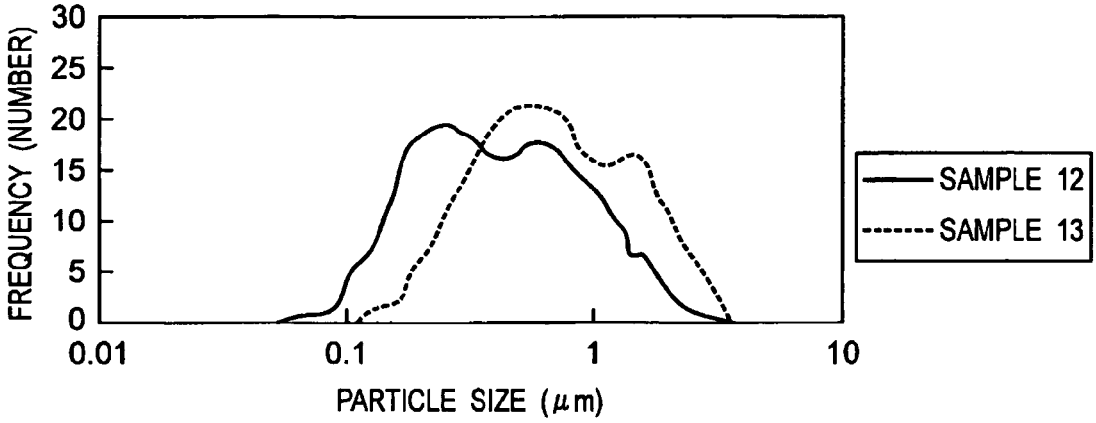
FIG. 10 is the results of measurements on particle size distribution of samples 12 to 13.

A toner layer containing reverse polarity particles was formed on one of electrodes of parallel flat plate electrodes. With respect to the toner, toner B in the Test Example 1 was used. The amount of strontium titanate forming reverse polarity particles contained in toner B was 2% by weight. When the amount of separated reverse polarity particles due to an electric field was evaluated from the toner layer formed on the electrode, the results shown in Table 5 were obtained. As shown in FIG. 5, the amount of separated reverse polarity particles due to an electric field was allowed to rise from about $2.5\times10^6$ V/m, and as the electric field was increased, the amount of separation was also increased. The above-mentioned facts indicate that in order to separate the reverse polarity particles contained in the toner by using an electric field, an electric field of $2.5\times10^6$ V/m or more is required and that in order to improve the separating and collecting properties of the reverse polarity particles, an application of an electric field of $2.5\times10^6$ V/m or more is effective.

Examples 5-10

Toners D to I were prepared in a manner similar to toner B except that external addition treatments described in Table 2 below were carried out.

TABLE 2

| | First externally adding process | | | | | | | Second externally adding process | | |
|---|---|---|---|---|---|---|---|---|---|---|
| | First particles | | Second particles | | Third particles | | *1 | Reverse polarity particles | | *1 |
| Toner B | Hydrophobic silica (16)*2 | *3 0.2 | Hydrophobic silica (20) | *3 0.5 | Hydrophobic titanium oxide (30) | *3 0.5 | 40 m/s for 3 minutes | Strontium titanate (350) | *3 2 | 40 m/s for 3 minutes |
| Toner D | Hydrophobic silica (16) | 0.2 | Hydrophobic silica (20) | 0.5 | — | — | 40 m/s for 3 minutes | Strontium titanate (350) | 2 | 40 m/s for 3 minutes |
| Toner E | Hydrophobic silica (16) | 0.2 | Hydrophobic silica (20) | 0.5 | — | — | 40 m/s for 3 minutes | Barium titanate (350) | 2 | 20 m/s for 3 minutes |
| Toner F | Hydrophobic silica (16) | 0.2 | Hydrophobic silica (20) | 0.5 | Hydrophobic titanium oxide (30) | 0.5 | 40 m/s for 3 minutes | Strontium titanate (350) | 2 | 40 m/s for 3 minutes |
| Toner G | Hydrophobic silica (16) | 0.2 | Hydrophobic silica (40) | 0.5 | — | — | 40 m/s for 3 minutes | Strontium titanate (350) | 2 | 40 m/s for 3 minutes |
| Toner H | Hydrophobic silica (16) | 0.2 | — | — | — | — | 40 m/s for 3 minutes | Strontium titanate (350) | 2 | 40 m/s for 3 minutes |
| Toner I | Hydrophobic silica (20) | 0.2 | — | — | — | — | 40 m/s for 3 minutes | Strontium titanate (350) | 2 | 40 m/s for 3 minutes |

*1: Rotation speed and processing time of Henschel mixer
*2: Figures in ( ) indicate average primary particle sizes (nm).
*3: Amounts of addition (parts by weight)

Toner D is prepared by removing hydrophobic titanium oxide that has been externally added thereto from toner B.

Toner E is prepared by changing the reverse polarity particles of toner D to barium titanate having a number-average primary particle size of 300 nm, with the rotation speed and the processing time of the Henschel mixer being respectively changed to 20 m/s and 3 minutes.

Toner F is prepared by miniaturizing the number average primary particle size of the hydrophobic titanium oxide externally added to toner B to 13 nm.

Toner G is prepared by enlarging the number average primary particle size of the second hydrophobic silica of toner D to 40 nm.

Toner H is prepared by further removing the second hydrophobic silica from toner D.

Toner I is prepared by enlarging the particle size of the first hydrophobic silica of toner H to 20 nm.

With respect to the above-mentioned toners D to I, the quantity of charge in toner was evaluated in the same manner as Example 1. The results are shown in Table 3 below.

TABLE 3

| | | | Quantity of charge in toner (μc/g) | | | |
|---|---|---|---|---|---|---|
| | Developing device | Toner | Initial | After 50k | Change in quantity of charge in toner | Evaluation on change in quantity of charge in toner |
| Example 1 | A | Toner B | 33.1 | 32.8 | −0.3 | ○ |
| Example 5 | A | Toner D | 34.6 | 30.2 | −4.4 | Δ |
| Example 6 | A | Toner E | 34.1 | 30 | −4.1 | Δ |
| Example 7 | A | Toner F | 33.7 | 29.4 | −4.3 | Δ |
| Example 8 | A | Toner G | 34.5 | 33.1 | −1.4 | ○ |
| Example 9 | A | Toner H | 34.2 | 28.1 | −6.1 | Δ− |
| Example 10 | A | Toner I | 28.9 | 24.9 | −4.0 | Δ− |

In Table 3, the amount of change of the quantity of charge in toner (absolute value) was evaluated and ranked on the basis of the following criteria.

○: the amount of change being less than 3 μC/g

Δ: the amount of change being 3 to less than 5 μC/g

Δ-: the amount of change being 5 to less than 7 μC/g

With respect to toners D and E, since hydrophobic titanium oxide (30 nm) has been removed from toner B, the effect of charge-maintaining properties is slightly lowered. In toner F prepared by changing the hydrophobic titanium oxide of toner B to that having a smaller size, the effect of charge-maintaining properties is slightly lowered. In toner H, since the second hydrophobic silica (20 nm) has also been removed, the effect of charge-maintaining properties is lowered.

In contrast, toner G, which is prepared by enlarging the size of the second hydrophobic silica of toner D, has an improved effect of charge-maintaining properties.

According to the facts above, it is understood that it is preferable that inorganic fine particles, which have a comparatively large size and a number-average primary particle size of 20 to 40 nm, are contained as an externally additive agent to be externally added to the toner other than the reverse polarity particles. The reason for this is because those particles having a comparatively large particle size are hardly secured (embedded) to the toner so that the reverse polarity particles that are externally added for the second time are interrupted from directly coming into contact with the toner base material; thus, it is considered that the reverse polarity particles are externally added thereto in a comparatively movable state. Consequently, the reverse polarity particles are easily separated from the toner under an alternating electric field, and easily collected.

In toner I, slight fogging in the background portion could be seen. The reason is thought as follows. The first hydrophobic silica having a toner charging function is made to have a larger size of 20 nm, the initial average quantity of charge is lowered, and the distribution of the quantity of charge becomes wider to cause an increase in the toner having a low quantity of charge. With respect to the effect of the charge-maintaining properties, there is no considerable change in comparison with toner D and toner E; however, in order to improve the charging function, it is understood that it is preferable to also externally add inorganic fine particles with a comparatively small particle size, having a number-average primary particle size of 9 to 16 nm, to the toner together with inorganic fine particles having a comparatively large particle size.

Example 11

(1) Developing Device and Setting Conditions

With respect to the developing device, developing device A and developing device B shown below were used.

Developing device A: A developing device having a structure shown in FIG. 1 was used, and to a developer-supporting member was applied a developing bias with a rectangular wave having an amplitude of 1.4 kV, a DC component of −400 V, a Duty ratio of 50% and a frequency of 2 kHz. A DC bias of −550 V, which had a potential difference of −150 V from the average potential of the developing bias and a potential difference of 850 V from the maximum potential of the developing bias, was applied to a reverse polarity particle-collecting member. With respect to the reverse polarity particle-collecting member, an aluminum roller the surface of which was alumite-treated was used, and a gap at the closest point between the developer-supporting member and the reverse polarity particle-collecting member was set to 0.3 mm. The background portion potential of an electrostatic latent image formed on the image supporting member was −550 V and the image portion potential thereof was −60 V. A gap at the closest point between the image supporting member and the developer-supporting member was set to 0.35 mm. The greatest value of the absolute value of a reverse polarity particle separating electric field formed between the reverse polarity particle-collecting member and the developer-supporting member was 850 V/0.3 mm=$2.8\times10^6$ V/m. The recovering operation of the reverse polarity particles collected by the reverse polarity particle-collecting member into the developer tank was carried out by reversing voltages to be applied to the developer-supporting member and the reverse polarity particle-collecting member in synchronized timing between copy sheets.

Developing device B: A developing device having a structure shown in FIG. 2 was used, and to a developer-supporting member was applied a DC voltage of −400 V. To a toner-supporting member was applied a developing bias with a rectangular wave having an amplitude of 1.6 kV, a DC component of −300 V, a Duty ratio of 50% and a frequency of 2 kHz. The average potential of the toner-supporting member had a potential difference of 100 V from the electric potential of the developer-supporting member, and the maximum potential difference was 900 V. With respect to the toner-supporting member, an aluminum roller the surface of which was alumite-treated was used, and a gap at the closest point between the developer-supporting member and the toner-supporting member was set to 0.3 mm. The background portion potential of an electrostatic latent image formed on the image supporting member was −550 V and the image portion potential thereof was −60 V. A gap at the closest point between the image supporting member and the toner-supporting member was set to 0.15 mm. The greatest value of the absolute value of a toner separating electric field formed between the toner-supporting member and the developer-supporting member was 900 V/0.3 mm=$3.0\times10^6$ V/m.

(2) Preparation of Developer

With respect to a developer, carrier (volume average particle size: about 33 μm) for bizhub C350 (made by Konica Minolta Business Technologies, Inc.) and each of the toners to which the following various particles were externally added were used, and the toner ratio in the developer was set to 8% by mass. The toner ratio was defined as a rate of the total amount of toner and post-treatment agents to the entire amount of the developer.

(3) Preparation of Toner Samples

With respect to the toner, a negatively chargeable toner having a particle size of about 6.5 μm, formed by a wet granulation method, was used. A toner base material (100 parts by mass) was subjected to a first externally adding process under conditions shown in Table 4, that is, externally adding particles serving as a fluidizing agent (first particles, second particles and third particles) were added thereto by using a Henschel mixer (made by Mitsui Kinzoku Kozan Co., Ltd.); thereafter, this was subjected to a second externally adding process, that is, particles 1 containing reverse polarity particles and particles 2 were added thereto by using a Henschel mixer (made by Mitsui Kinzoku Kozan Co., Ltd.). In the Table, charging particles whose polarity is indicated as "minus" are particles having the same polarity as the toner.

The hydrophobic silica to be used here was prepared by carrying out a surface treatment on silica by using hexamethyldisilazane (HMDS) serving as a hydrophobicity-applying agent. The hydrophobic titanium oxide, used in the first externally adding process, was prepared by carrying out a surface treatment on anatase-type titanium oxide in an aqueous wet system by using isobutyl trimethoxysilane serving as a hydrophobicity-applying agent. The hydrophobic titanium oxide serving as particles 1, used in the second externally adding process, was prepared by carrying out a surface treatment on anatase-type titanium oxide in an aqueous wet system by using isobutyl trimethoxysilane serving as a hydrophobicity-applying agent. The hydrophobic titanium oxide serving as particles 2, used in the second externally adding process, was prepared by carrying out a surface treatment on anatase-type titanium oxide in an aqueous wet system by using aminosilane serving as a hydrophobicity-applying agent. With respect to the pulverizing process, a Henschel mixer was used at 50/s for 5 minutes.

The results of particle-size distribution measurements of the externally adding agents relating to samples 1 to 13 are shown in FIGS. 6 to 10. The peak value of the particle size distribution of each of the samples and comparative samples is shown in Table 4.

Here, the second peak value indicates the peak value of reverse polarity particles. This is also confirmed by the fact that, when the particle size distribution of externally adding agents was measured after the reverse polarity particles had been separated from the developer, the second peak hardly appeared.

TABLE 4

| | First process | | | | | | | Second process | | |
|---|---|---|---|---|---|---|---|---|---|---|
| | | | | | | | | Particles 1 | | |
| | First particle | | Second particle | | Third particle | | Conditions | | | Particle quantity of |
| Toner | *1 | *2 | *1 | *2 | *1 | *2 | *3 | *1 | *2 | charge (μC/g) |
| Sample 1 | *4 (16) | 0.2 | *4 (20) | 0.5 | *5 (30) | 0.5 | *6 | *4 (100) | 0.5 | Minus |
| Sample 2 | *4 (16) | 0.2 | *4 (20) | 0.5 | *5 (30) | 0.5 | *6 | *8 (100) | 0.5 | 210 |
| Sample 3 | *4 (16) | 0.2 | *4 (20) | 0.5 | *5 (30) | 0.5 | *6 | *9 (50-80) | 2 | 430 |
| Sample 4 | *4 (16) | 0.2 | *4 (20) | 0.5 | *5 (30) | 0.5 | *6 | *10 (300) | 2 | 320 |
| Sample 5 | *4 (16) | 0.2 | *4 (20) | 0.5 | *5 (30) | 0.5 | *6 | *10 (200) | 0.5 | 290 |
| Sample 6 | *4 (16) | 0.2 | *4 (20) | 0.5 | *5 (30) | 0.5 | *6 | *5 (100) | 0.5 | Minus |
| Sample 7 | *4 (16) | 0.2 | *4 (20) | 0.5 | *5 (30) | 0.5 | *6 | *9 (80) | 2.0 | 450 |
| Sample 8 | *4 (16) | 0.2 | *4 (20) | 0.5 | *5 (30) | 0.5 | *6 | *11 (250) | 2 | 290 |
| Sample 9 | *4 (16) | 0.2 | *4 (20) | 0.5 | *5 (30) | 0.5 | *6 | *8 (50) | 0.5 | 270 |
| Sample 10 | *4 (16) | 0.2 | *4 (20) | 0.5 | *5 (30) | 0.5 | *6 | *10 (100) | 0.5 | 310 |
| Sample 11 | *4 (16) | 0.2 | *4 (20) | 0.5 | *5 (30) | 0.5 | *6 | *10 (200) | 0.5 | 290 |
| Sample 12 | *4 (16) | 0.2 | *4 (20) | 0.5 | *5 (30) | 0.5 | *6 | *4 (100) | 0.5 | Minus |
| Sample 13 | *4 (16) | 0.2 | *4 (20) | 0.5 | *5 (30) | 0.5 | *6 | *9 (80-100) | 2.0 | 420 |
| Comparative sample 1 | *4 (16) | 0.2 | *4 (20) | 0.5 | *5 (30) | 0.5 | *6 | — | — | — |

| Second process | | | | Particle size of externally adding particles | |
|---|---|---|---|---|---|
| Particles 2 | | | | Distribution peak value | |
| *1 | *2 | Particle quantity of charge (μC/g) | Conditions *3 | First peak | Second peak |
| Titanium oxide (120) | 1.5 | 200 | *6 | 0.3 | 0.8 |
| Aluminum oxide (200) | 1.5 | 250 | *6 | 0.2 | 0.8 |
| — | — | — | *6 | 0.5 | 1.5 |
| — | — | — | *7 | 0.5 | 1.3 |
| *5 (200) | 1.5 | 180 | *6 | 0.2 | 1.5 |
| *5 (120) | 1.5 | 200 | *6 | 0.6 | 0.8 |
| — | — | — | *6 | 0.6 | 1.5 |
| — | — | — | *6 | 0.4 | 1.2 |
| Aluminum oxide (200) | 1.5 | 250 | *6 | 0.1 | 0.8 |
| *5 (200) | 1.5 | 180 | *6 | 0.1 | 1.5 |
| *5 (230) | 1.5 | 160 | *6 | 0.2 | 1.6 |
| *5 (100) | 1.5 | 220 | *6 | 0.3 | 0.7 |
| — | — | — | *6 | 0.7 | 1.5 |
| — | — | — | — | 0.1 or less | — |

*1: Material name (average primary particle size nm)
*2: Amount or addition (parts by mass)
*3: Henschel mixer (rotation speed, processing time)
*4: Hydrophobic silica
*5: Hydrophobic titanium oxide
*6: 40 m/s, 3 minutes
*7: 20 m/s, 3 minutes
*8: Strontium titanate
*9: Strontium titanate that has been pulverized
*10: Barium titanate
*11: Magnesium titanate Evaluation Method of Examples and Comparative Examples The toner samples and the developing devices shown in Table 5 were installed in the image-forming apparatuse prepared by revising the copying machine bizhub C350 made by Konica Minolta Business Technologies, Inc., and endurance tests of 50,000 copies (A4 lateral feed) were carried out by using an image chart with an image area rate of about 5% so that the quantity of charge of toner and the cleaning quality of the developer were evaluated in the initial state and after the endurance tests, respectively.

In any one of the image forming apparatuses, with respect to the supply toner, each of toner samples that had been subjected to externally-adding processes respectively described in Examples and Comparative Examples was used. The developer was sampled from the developer tank. The amount of change of the quantity of charge in toner (absolute value) was evaluated and ranked on the basis of the following criteria.

○: the amount of change being less than 3 μC/g

Δ: the amount of change being 3 to less than 5 μC/g

Δ-: the amount of change being 5 to less than 7 μC/g

X: the amount of change being 7 μC/g or more

With respect to the evaluation on the cleaning quality of the photosensitive member, a blank image was printed and lines (black lines due to remaining toner after cleaning) in the paper feeding direction were evaluated in three grades. No occurrence of black lines was evaluated as ○; occurrence of very slight black lines that would cause no problems in practical use was evaluated as Δ; and occurrence of black lines that would cause problems in quality was evaluated as x.

(Measuring Method of Quantity of Charge in Toner)

The measuring process of the quantity of charge in toner was carried out by using a device shown in FIG. 4. First, a developer (1 g) the weight of which had been measured by a precision balance was placed on the entire surface of a conductive sleeve (31) uniformly. The number of revolutions of a magnet roll (32), installed inside the conductive sleeve (31), was set to 1000 rpm, with a voltage of 2 kV being supplied to the sleeve (31) from a bias power supply (33). The device was held in this state for 30 seconds so that toner was collected on a cylinder electrode (34). After a lapse of 30 seconds, the electric potential Vm of the cylinder electrode (34) was read and the quantity of charge in the toner was found, and the mass of the collected toner was measured by a precision balance so that the average quantity of charge was found.

(Measuring Method of Quantity of Charge in Particles)

The measuring process of the quantity of charge in particles shown in Table 4 was carried out by using the device shown in FIG. 4.

A toner to which particles to be measured had been externally added was mixed with carrier to prepare a developer, and 1 g of this was placed on the conductive sleeve (31). The succeeding operations were the same as those of the measuring process of quantity of charge in toner; however, a bias voltage having a polarity used for collecting only the particles is applied to the cylinder electrode (34). Particles having the same polarity of the toner can not be measured.

(Measuring Method of Distribution of Particle Size)

Upon measuring the particle size distribution of an externally additive agent to be used in the present invention, among particle images obtained from a scanning electronic microscope, 300 particle images were image-processed by using an Image-Pro made by Planetron Inc. as image processing software so that particle sizes were found and subjected to statistical processes. The number of measuring particles may be set to 300 or more. The measurements may be carried out by using another method in which a laser scattering type particle size measuring device, such as SALD 2200 (made by Shimadzu Seisakusho K.K.), is used.

(Results of Evaluation)

With respect to the Examples and Comparative Examples, the results of evaluation on the quantity of charge in toner between the initial state and the state after the endurance tests of 50 k prints as well as on the black lines after the endurance tests of 50 k prints are shown in Table 5.

TABLE 5

| | | | Quantity of charge in toner (μc/g) | | | | |
|---|---|---|---|---|---|---|---|
| | Developing device | Sample | Initial | After 50k | Change in quantity of charge in toner | Evaluation on change in quantity of charge in toner | Black line ranks |
| Example 11-1 | A | Sample 1 | 31.5 | 26.3 | −5.2 | Δ− | ○ |
| Example 11-2 | A | Sample 2 | 32.1 | 30.4 | −1.7 | ○ | Δ |
| Example 11-3 | A | Sample 3 | 34.6 | 34.2 | −0.4 | ○ | ○ |
| Example 11-4 | B | Sample 3 | 34.1 | 35.3 | 1.2 | ○ | ○ |
| Example 11-5 | A | Sample 4 | 34.8 | 34.1 | −0.7 | ○ | ○ |
| Example 11-6 | A | Sample 5 | 32.5 | 31.8 | −0.7 | ○ | ○ |
| Example 11-7 | A | Sample 6 | 33.1 | 29 | −4.1 | Δ | ○ |
| Example 11-8 | A | Sample 7 | 34.2 | 33.2 | −1.0 | ○ | ○ |
| Example 11-9 | A | Sample 8 | 33.9 | 33.8 | −0.1 | ○ | ○ |
| Example 11-10 | A | Sample 9 | 32.5 | 30.4 | −2.1 | ○ | x |
| Example 11-11 | A | Sample 10 | 31.9 | 31 | −0.9 | ○ | x |
| Example 11-12 | A | Sample 11 | 31.8 | 24.7 | −6.8 | Δ− | ○ |
| Example 11-13 | A | Sample 12 | 33.4 | 24.5 | −6.9 | Δ− | ○ |
| Example 11-14 | A | Sample 13 | 34.1 | 33.7 | −0.4 | ○ | x |
| Comparative Example 11-1 | A | Comparative Sample 1 | 34.7 | 19.4 | −15.3 | x | x |

The results indicate that by using a developer containing particles that have a particle size distribution with a peak particle diameter of 0.2 μm to 0.6 μm and reverse polarity particles that have a particle size distribution with a peak particle diameter of 0.8 μm to 1.5 μm in a developing device having a structure for collecting the reverse polarity particles as shown in FIGS. 1 and 2, the quantity of charge in the toner is allowed to shift in a stable manner without reduction and the cleaning function is also improved; thus, it becomes possible to ensure stable quality for a long time.

Since Example 11-1 and Example 11-6 tend to have slight reduction in the quantity of charge, it is found that the particles having a peak in a range from 0.2 μm to 0.6 μm are preferably designed to have a charge polarity reversed to the polarity of the toner.

What is claimed is:

1. A developing device, comprising:

a developer tank that houses a developer containing a toner, a carrier for charging the toner, and reverse polarity particles that are charged with polarity opposite to a charge polarity of the toner, the reverse polarity particles being externally added to the carrier;

a developer-supporting member that supports the developer supplied from the developer tank to transport the developer toward a developing area; and a separating mechanism that separates the reverse polarity particles or the toner in the developer on the developer-supporting member from each other, at a position which is on an upstream side of the developing area in a developer-moving direction.

2. The developing device according to claim 1, wherein the separating mechanism comprises an electric-field-forming member that faces the developer-supporting member and forms an electric field for separating the reverse polarity particles from the developer supported on the developer-supporting member.

3. The developing device according to claim 2, wherein an AC electric field is formed between the electric-field-forming member and the developer-supporting member.

4. The developing device according to claim 3, wherein the AC electric field has a maximum value in an absolute value of 2.5×106 V/m or more.

5. The developing device according to claim 2, wherein the electric-field-forming member is also used as a member for regulating the developer on the developer-supporting member.

6. The developing device according to claim 2, wherein the electric-field-forming member forms one portion of a casing of the developing device.

7. The developing device according to claim 1, wherein the separating mechanism comprises a toner-supporting member that is installed between the developing area and the developer-supporting member and separates the toner from the developer supported on the developer-supporting member to transport the toner to the developing area.

8. The developing device according to claim 7, wherein the toner is negatively charged and an average value of a voltage applied to the toner-supporting member is higher than an average voltage of a voltage applied to the developer-supporting member.

9. The developing device according to claim 7, wherein the toner is positively charged and an average value of a voltage applied to the toner-supporting member is lower than an average voltage of a voltage applied to the developer-supporting member.

10. The developing device according to claim 7, wherein an AC electric field is formed between the toner-supporting member and the developer-supporting member.

11. The developing device according to claim 10, wherein the AC electric field has a maximum value in an absolute value of 2.5×106 V/m or more.

12. The developing device according to claim 1, wherein the reverse polarity particles have a number average primary particle size in the range from 100 to 1000 nm.

13. The developing device according to claim 1, wherein the amount of the reverse polarity particles is set to 0.01 to 5.00 parts by weight with respect to 100 parts by weight of the carrier.

14. The developing device according to claim 1, wherein the amount of the reverse polarity particles is set to 0.01 to 2.00 parts by weight with respect to 100 parts by weight of the carrier.

15. The developing device according to claim 1, further comprising: a supplying mechanism that supplies supply toner to the developer tank, wherein reverse polarity particles have been externally added to the supply toner.

16. The developing device according to claim 15, wherein the amount of the externally added reverse polarity particles in the supply toner is set in the range from 0.1 to 10.0% by weight with respect to the supply toner.

17. The developing device according to claim 15, wherein the amount of the externally added reverse polarity particles in the supply toner is set in the range from 0.5 to 5.0% by weight with respect to the supply toner.

18. The developing device according to claim 1, wherein an externally additive agent is added to the toner, with the externally additive agent having a number average primary particle size in the range from 9 to 100 nm.

19. The developing device according to claim 18, wherein the externally additive agent is composed of inorganic fine particles having a number average primary particle size in the range from 20 to 40 nm.

20. The developing device according to claim 18, wherein the externally additive agent is composed of inorganic fine particles having a number average primary particle size in the range from 9 to 16 nm.

21. The developing device according to claim 18, wherein the externally additive agent contains first particles having an average particle size smaller than that of the reverse polarity particles and second particles that have an average particle size that is smaller than that of the reverse polarity particles and greater than that of the first particles.

22. The developing device according to claim 21, wherein the first particles have an average primary particle size in the range from 9 to 16 nm, and the second particles have an average primary particle size in the range from 20 to 40 nm.

23. The developing device according to claim 1, further comprising second large particles, wherein the reverse polarity particles have a particle size distribution with a peak particle size of 0.8 to 1.5 mm, and the second large particles have a particle size distribution with a peak particle size of 0.2 to 0.6 mm.

24. The developing device according to claim 23, wherein the second large particles are externally added to the toner.

25. The developing device according to claim 23, wherein the second large particles are charged with polarity reversed to the charge polarity of the toner.

26. The developing device according to claim 23, wherein the amount of the reverse polarity particles is set in the range from 0.1 to 5.0% by mass with respect to the toner.

27. The developing device according to claim 26, wherein the amount of the reverse polarity particles is set in the range from 0.5 to 3.0% by mass with respect to the toner.

28. The developing device according to claim 23, wherein the amount of the second large particles is set in the range from 0.01 to 5.0% by mass with respect to the toner.

29. The developing device according to claim 28, wherein the amount of the second large particles is set in the range from 0.1 to 2.0% by mass.

30. An image-forming apparatus, comprising:

an electrostatic latent image supporting member;

an image forming mechanism that forms an electrostatic latent image on the electrostatic latent image supporting member;

the developing device of claim 1, which develops the electrostatic latent image formed on the electrostatic latent image supporting member to make a toner image; and a transferring mechanism which transfers the toner image on the electrostatic latent image supporting member onto a medium.

31. A method of developing an electrostatic latent image in a developing area to make a toner image, comprising:

transporting a developer housed in a developer tank toward the developing area by using a developer-supporting member, the developer containing a toner, a carrier for charging the toner and reverse polarity particles that are charged with polarity reversed to a charge polarity of the toner;

separating the reverse polarity particles from the developer supported on the developer-supporting member with the toner and the carrier left on the developer-supporting member, at a position which is on an upstream side of the developing area in a developer-moving direction so that the developer from which the reverse polarity particles have been separated is transported to the developing area and the toner and the carrier remain on the developer supporting member; and collecting the reverse polarity particles separated into the developer tank.

32. A method of developing an electrostatic latent image in a developing area to make a toner image, comprising:

transporting a developer housed in a developer tank toward the developing area by using a developer-supporting member, the developer containing a toner, a carrier for charging the toner and reverse polarity particles that are charged with polarity reversed to a charge polarity of the toner; and separating the toner from the developer supported on the developer-supporting member with the reverse polarity particles and the carrier left on the developer-supporting member, at a position on an upstream side of the developing area in a developer-moving direction so as to transport the toner to the developing area.

* * * * *